US009399347B1

(12) United States Patent
Mizuno et al.

(10) Patent No.: US 9,399,347 B1
(45) Date of Patent: Jul. 26, 2016

(54) PRINT DEVICE

(71) Applicant: BROTHER KOGYO KABUSHIKI KAISHA, Nagoya-shi, Aichi (JP)

(72) Inventors: Naoki Mizuno, Takahama (JP); Takao Hyakudome, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 15/007,983

(22) Filed: Jan. 27, 2016

(30) Foreign Application Priority Data

Jan. 28, 2015 (JP) ..... 2015-013894

(51) Int. Cl.
*B41J 2/15* (2006.01)
*B41J 2/165* (2006.01)

(52) U.S. Cl.
CPC .... *B41J 2/16552* (2013.01); *B41J 2002/16558* (2013.01)

(58) Field of Classification Search
CPC ..... B41J 2/16523; B41J 2/16547; B41J 2/16552; B41J 2002/16573; B41J 2/1721; B41J 11/0085; B41J 2002/1657; B41J 2002/17569
See application file for complete search history.

(56) References Cited

U.S. PATENT DOCUMENTS 6,869,160 B2 * 3/2005 West ..... B41J 2/1707 347/28
8,556,375 B2 * 10/2013 Loyd ..... B41J 2/16532 347/29
8,727,491 B2 * 5/2014 Watanabe ..... B41J 2/16526 347/35

FOREIGN PATENT DOCUMENTS

JP H09-183233 A 7/1997

* cited by examiner

*Primary Examiner* — Lamson Nguyen
(74) *Attorney, Agent, or Firm* — Fox Rothschild LLP

(57) ABSTRACT

A nozzle arrangement has nozzle arrays arranged in a first direction. Liquid passages are interconnected via a communication path and arranged in the first direction. Nozzles in each one of the nozzle arrays are connected to a corresponding one of the liquid passages. Each of the liquid passages has a first end connected to a supply port and a second end connected to the communication path, in a second direction. The controller controls a flushing operation ejecting liquid from the nozzles as waste liquid. The controller controls the head portion to perform a selective flushing operation. The selective flushing operation is an operation of ejecting the liquid from the nozzles corresponding to a part, being at least one of the liquid passages, of a set of liquid passages while stopping ejection of the liquid from the nozzles corresponding to a remaining part of the set of liquid passages.

15 Claims, 16 Drawing Sheets

PRINT DEVICE

CROSS-REFERENCE TO RELATED APPLICATION

This application claims priority to Japanese Patent Application No. 2015-13894 filed on Jan. 28, 2015, the disclosure of which is herein incorporated by reference in its entirety.

BACKGROUND

The present disclosure relates to a print device.

Print devices are known that perform printing by ejecting ink onto a print medium from nozzles of a print head. Amongst this type of print device, a print device is known that performs flushing in order to improve an ejection state of the ink. The flushing is an operation that causes the ink to be ejected from the nozzles when printing is not being performed. A device is known which includes a print head provided with many nozzles that are divided into a plurality of sections, and which performs the flushing at timings that are different from each other for each section.

SUMMARY

There are a variety of forms of ink passages inside the print head. For example, there is a case in which a communication path is provided via which ends of a plurality of ink passages are interconnected. Depending on the form of the ink passages, when the known flushing is simply applied, the ejection state of the ink is not improved sufficiently and, as a result, deterioration in print quality of the print device tends to occur.

Various embodiments of the general principles derived herein provide a print device that can reduce a possibility of a deterioration in print quality occurring.

Embodiments herein provide a print device including a head portion, a set of liquid passages and a controller. The head portion includes a nozzle arrangement. The nozzle arrangement has nozzle arrays arranged in a first direction. Each of the nozzle arrays has nozzles arranged in a second direction crossing the first direction. Each of the nozzles is provided to eject liquid. The set of liquid passages is provided to supply the liquid to the nozzle arrangement. The set of liquid passages has liquid passages. The liquid passages are interconnected via a communication path. The liquid passages are arranged in the first direction. The nozzles in each one of the nozzle arrays are connected to a corresponding one of the liquid passages. Each of the liquid passages extends in the second direction. Each of the liquid passages has a first end and a second end in the second direction. The first end is connected to a supply port provided to supply the liquid to the liquid passage. The second end is an end opposite to the first end and is connected to the communication path. The controller is configured to control a flushing operation of the head portion. The flushing operation is an operation of ejecting the liquid from the nozzles as waste liquid. The waste liquid is not used for printing. The controller is configured to control the head portion to perform a selective flushing operation. The selective flushing operation is an operation of ejecting the liquid from the nozzles corresponding to a part, being at least one of the liquid passages, of the set of liquid passages while stopping ejection of the liquid from the nozzles corresponding to a remaining part of the set of liquid passages.

BRIEF DESCRIPTION OF THE DRAWINGS

Embodiments will be described below in detail with reference to the accompanying drawings in which.

DETAILED DESCRIPTION

A schematic configuration of a printer 1 will be explained with reference to FIG. 1 and FIG. 2. The upper side, the lower side, the lower left side, the upper right side, the lower right side and the upper left side of FIG. 1 respectively correspond to the upper side, the lower side, the front side, the rear side, the right side and the left side of the printer 1.

Figure 1:
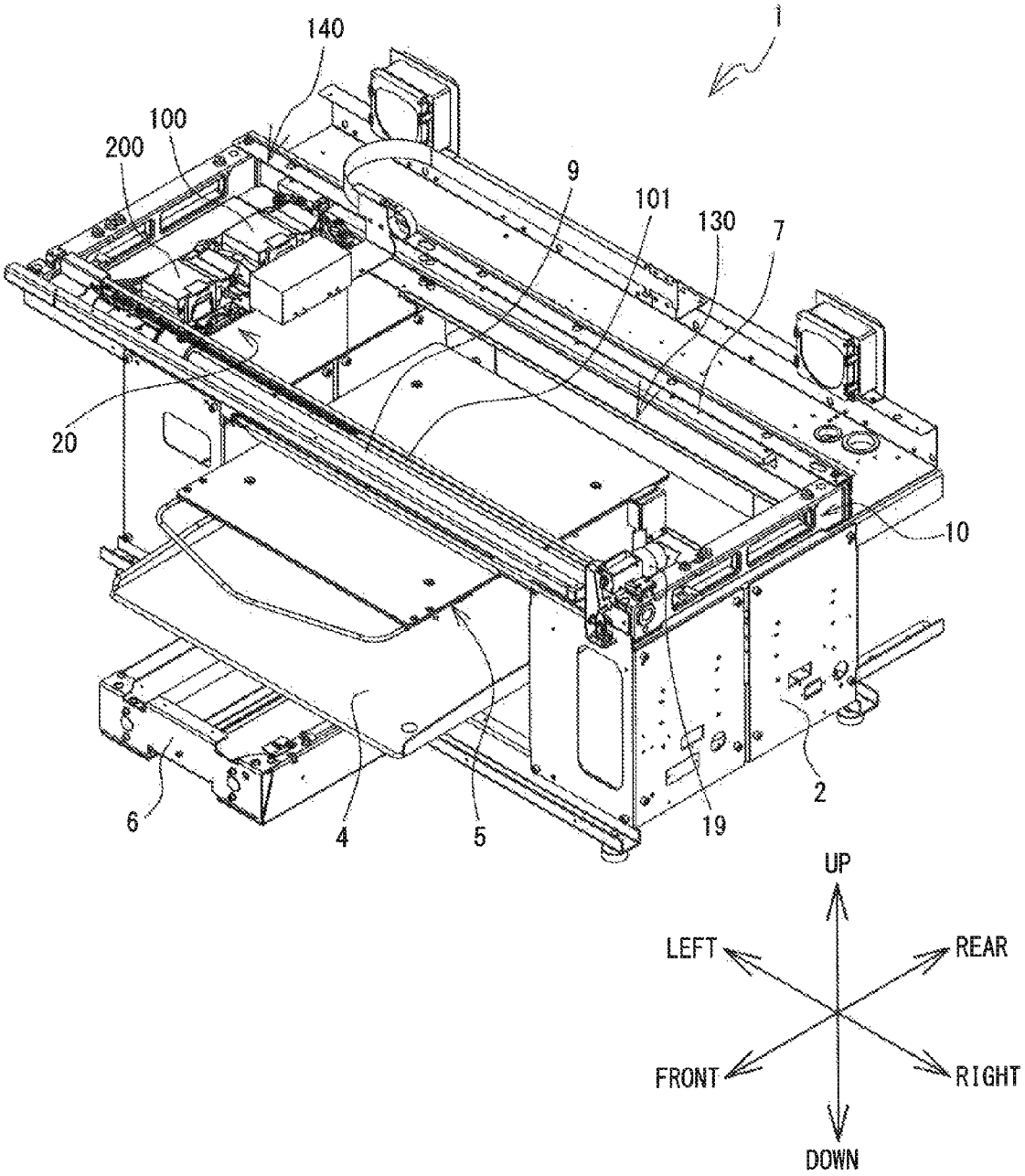
FIG. 1 is a perspective view of a printer.

As shown in FIG. 1, the printer 1 is an inkjet printer that performs printing by ejecting liquid ink onto a print medium (not shown in the drawings). The print medium of the printer 1 is a fabric, such as a T-shirt. The printer 1 may use paper or the like as the print medium. The printer 1 can print a color image on the print medium by downwardly ejecting five types of ink (white (W), black (K), yellow (Y), cyan (C) and magenta (M) inks) that are different in color from each other. In the explanation below, of the five types of ink, the white color ink is referred to as a white ink, and the inks of the four colors of black, cyan, yellow and magenta are collectively referred to as color inks. When the white ink and the color inks are collectively referred to or when one of the inks is not specified, the inks are simply referred to as ink.

The white ink that is used for the printer 1 of the present embodiment contains titanium oxide as a pigment. The titanium oxide is an inorganic pigment having a relatively high specific gravity. When the titanium oxide pigment is used in an inkjet ink having a low viscosity, pigment particles are likely to be deposited. Therefore, for example, when the printing of the white ink is not performed for a long time, it is likely that the pigment particles may sediment and clogging may occur in ink passages inside the printer 1. In order to inhibit the clogging of the ink passages, it is necessary to maintain the fluidity of the white ink inside the ink passages by causing the white ink to be agitated. Although the color ink also contains pigment, the pigment contained in the color ink is less likely to sediment compared to the titanium oxide pigment contained in the white ink.

Figure 2:
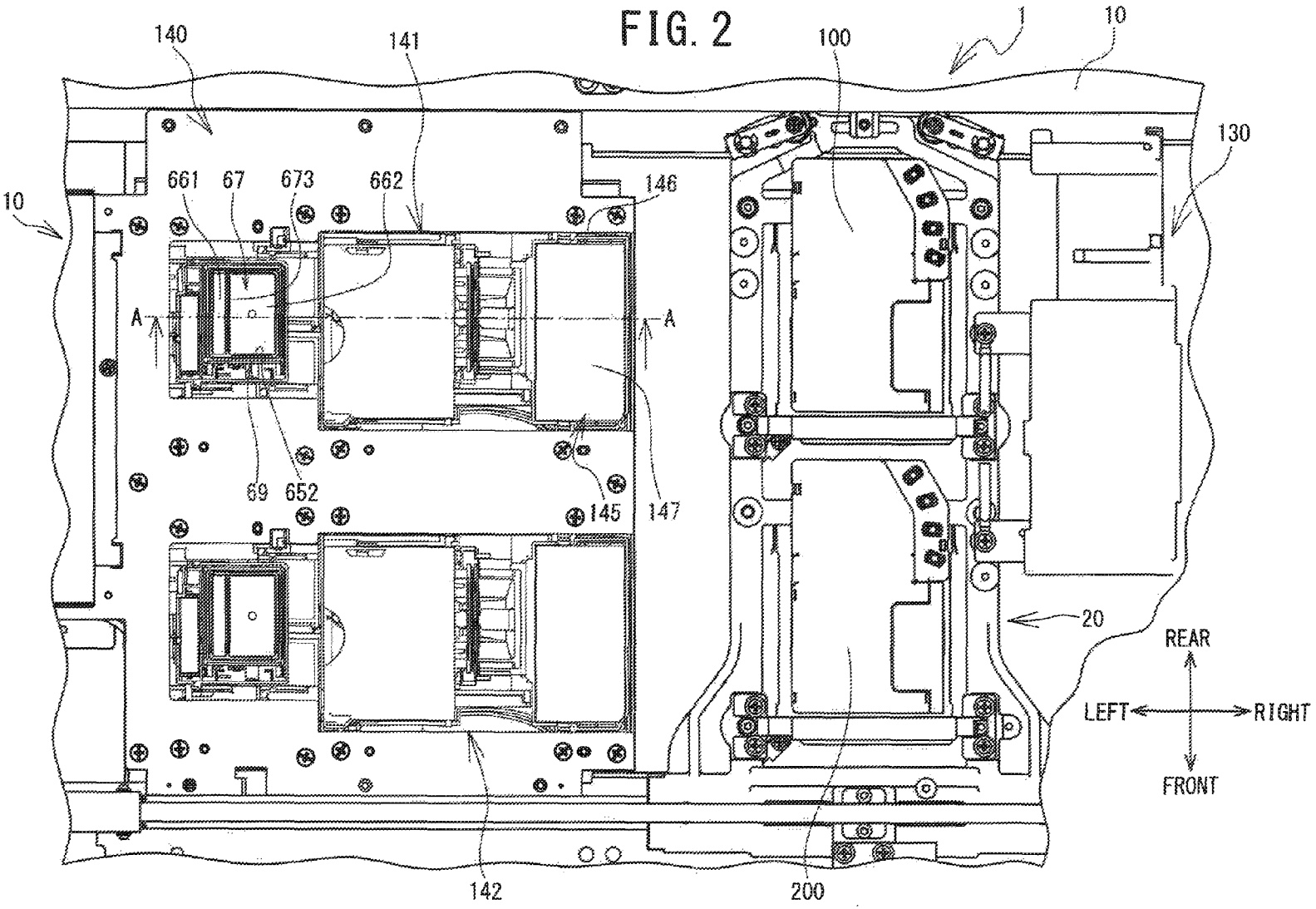
FIG. 2 is a plan view of the printer.

As shown in FIG. 1 and FIG. 2, the printer 1 is provided with a housing 2, a frame body 10, a guide shaft 9, a rail 7, a carriage 20, head units 100 and 200, a drive belt 101, a drive motor 19, a platen drive mechanism 6, a platen 5 and a tray 4. Further, the printer 1 is provided with maintenance portions 141 and 142 in a non-print area 140 that will be described later.

The housing 2 has a substantially cuboid shape that is long in the left-right direction. An operation portion (not shown in the drawings) used to perform operations of the printer 1 is provided in a front position on the right side of the housing 2. The operation portion is provided with a display 49 (refer to FIG. 10) and operation buttons 501 (refer to FIG. 10). The display 49 displays various types of information. The operation buttons 501 are operated when an operator inputs a command relating to various types of operations of the printer 1.

The frame body 10 has a frame shape and is substantially rectangular in a plan view. The frame body 10 is installed on an upper portion of the housing 2. The frame body 10 supports the guide shaft 9 on the front side and supports the rail 7 on the rear side, respectively. The guide shaft 9 is a shaft member and extends in the left-right direction inside the frame body 10. The rail 7 is a rod-like member that extends in the left-right direction, and is disposed facing the guide shaft 9.

The carriage 20 is supported such that it can be conveyed in the left-right direction along the guide shaft 9. As shown in FIG. 1 and FIG. 2, the head units 100 and 200 are installed on the carriage 20 such that they are arranged side by side in the front-rear direction. The head unit 100 is positioned to the rear of the head unit 200. A bottom portion of the head unit 100 is provided with a head portion 110 that can eject ink toward the print medium (refer to FIG. 3). A bottom portion of the head unit 200 is configured in the same manner as the head unit 100. The head portion 110 is provided with a nozzle surface 112 (refer to FIG. 3), which is a surface having a plurality of fine nozzles 111 (refer to FIG. 3) that can eject ink downwardly.

The drive belt 101 is a band-shaped member, and is stretched along the left-right direction on the inside of the frame body 10. The drive belt 101 is made of a flexible synthetic resin. The drive motor 19 is provided on the front right on the inside of the frame body 10. The drive motor 19 can rotate in the forward direction and the reverse direction, and is coupled to the carriage 20 via the drive belt 101. When the drive motor 19 drives the drive belt 101, the carriage 20 reciprocates in the left-right direction (a scanning direction). As a result, the head units 100 and 200 reciprocate in the left-right direction. During the reciprocating movement, the head units 100 and 200 eject ink toward the print medium supported by the platen 5 that is disposed facing the head units 100 and 200 below the head units 100 and 200.

The platen drive mechanism 6 is provided with a pair of guide rails (not shown in the drawings), the platen 5 and the tray 4. The pair of guide rails extend in the front-rear direction inside the platen drive mechanism 6, and support the platen 5 and the tray 4 such that they can move in the front-rear direction. The platen 5 is a substantially rectangular plate-shaped member in a plan view and is long in the front-rear direction. The platen 5 is provided below the frame body 10 that will be described later. An upper portion of the platen 5 holds the print medium. The tray 4 has a rectangular shape in a plan view and is provided below the platen 5. When a user places a T-shirt or the like on the platen 5, the tray 4 receives a sleeve or the like of the T-shirt. Therefore, the sleeve or the like is protected such that it does not come into contact with another component provided inside the housing 2. When the platen drive mechanism 6 is driven by a sub-scanning drive portion 46 (refer to FIG. 10) that will be described later, the platen drive mechanism 6 moves the platen 5 in the front-rear direction along the pair of guide rails. The ink is ejected from the head portion 110 that reciprocates in the left-right direction while the platen 5 is feeding the print medium in the front-rear direction (a sub-scanning direction), and thus the printing is performed on the print medium by the printer 1.

As shown in FIG. 1 and FIG. 2, the carriage 20 is disposed on the inside of the frame body 10. Therefore, the head units 100 and 200 move in the left-right direction between a left end portion and a right end portion of the inside of the frame body 10. Within the movement path of the head units 100 and 200, an area in which the printing is performed by the head units 100 and 200 is referred to as a print area 130. An area other than the print area 130 within the movement path of the head units 100 and 200 is referred to as the non-print area 140. The non-print area 140 is a left end area of the printer 1. The print area 130 is an area from the right side of the non-print area 140 to a right end portion of the printer 1. The platen 5 and the tray 4 are provided in the print area 130.

As shown in FIG. 2, in the non-print area 140, the maintenance portions 141 and 142 are provided below the movement path of the head units 100 and 200, respectively. Various maintenance operations, such as flushing, purging and the like, are performed by the maintenance portions 141 and 142 in order to restore an ink ejection performance of the head units 100 and 200 and to secure the print quality of the printer 1. The flushing is an operation in which the head portion 110 ejects the ink above a flushing reception portion 145 (refer to FIG. 2), which will be described later, before the printing is performed on the print medium. By performing the flushing, the ink in the nozzles 111 is inhibited from drying up. Therefore, the ink is appropriately ejected from the head portion 110 when the printing is performed on the print medium. The purging is an operation to suck ink containing foreign matter or air bubbles etc. from the nozzles 111 by a suction pump 199 (refer to FIG. 10) and to discharge the ink from the nozzles 111, in a state in which the nozzles 111 are covered by a cap 67 (refer to FIG. 2 and FIG. 9), which will be described later, on the nozzle surface 112. By performing the purging, the ink containing foreign matter or air bubbles etc. is discharged from the head portion 110. It is therefore possible to reduce the possibility of an ejection failure occurring in the head portion 110. These maintenance operations are performed by control of a CPU 40 (refer to FIG. 10) of the printer 1. The maintenance portions 141 and 142 will be described in more detail later.

Configurations of the head units 100 and 200 will be explained in detail with reference to FIG. 3 and FIG. 4. The head unit 100 ejects the white ink. The head unit 200 ejects the color inks. Before the color inks are ejected, the white ink is ejected onto the whole or a part of the area in which the printing is performed, as a base for printing when the color of the print medium is dark or the like. After the white ink is ejected onto the whole or a part of the area in which the printing is performed, the color inks are used to draw a color image, such as a pattern, in that area. Depending on the print image and the color of the print medium, the color inks need not necessarily be ejected after the white ink is ejected. Depending on the print image and the color of the print medium, the white ink may be ejected to print a pattern or the like. On the print medium, there may be an area in which only the white ink is ejected or an area in which only the color inks are ejected. In this manner, the printer 1 can perform various types of printing, regardless of the color of the print medium. The head unit 200 has a similar configuration to that of the head unit 100, except that the head unit 200 ejects the color inks instead of the white ink. Therefore, an explanation of the head unit 200 will be omitted as necessary.

Figure 3:
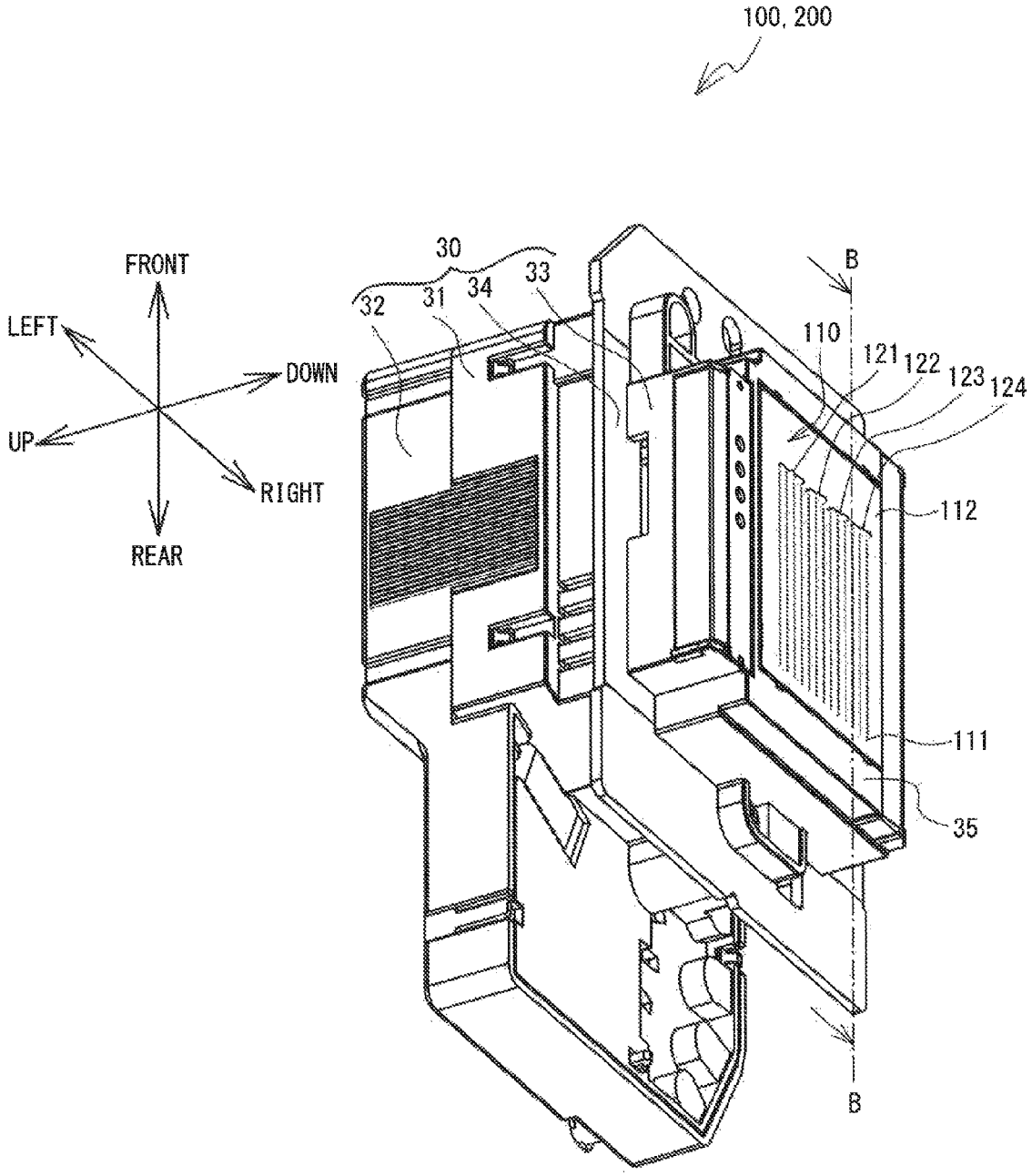
FIG. 3 is a perspective view of a head unit.
Figure 4:
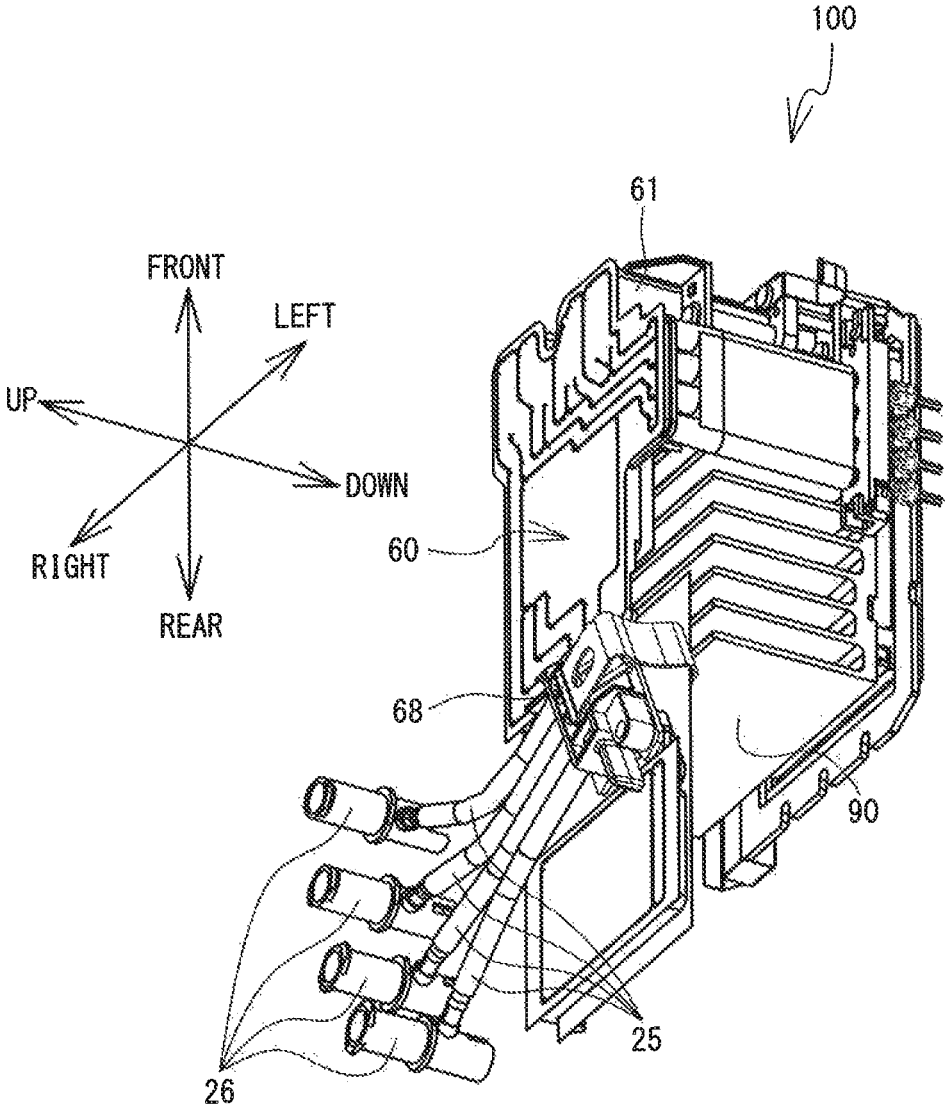
FIG. 4 is a perspective view of the interior of the head unit.

As shown in FIG. 3 and FIG. 4, the head unit 100 is provided with a housing 30, the head portion 110 and a buffer tank 60. As shown in FIG. 3, the housing 30 is a substantially box-shaped support body, and the head portion 110 is supported at a bottom portion of the housing 30. The housing 30 is provided with a support base 34, a middle housing 31, an upper housing 32 and a lower housing 33. The support base 34 is a metal plate member having a rectangular frame shape in a plan view. A through hole (not shown in the drawings) is formed in a central portion of the support base 34. The middle housing 31 is made of a synthetic resin and has a square tube shape extending upward from the support base 34. The middle housing 31 is fixed to an upper surface of the support base 34, in a position where a tube hole of the middle housing 31 is connected with the through hole of the support base 34. The upper housing 32 is made of a synthetic resin and has a substantially box shape whose lower side is open. The upper housing 32 is provided such that it covers the tube hole of the middle housing 31 and the buffer tank 60 (refer to FIG. 4) from the upper side, which is a side opposite to the head portion 110. The lower housing 33 is made of a synthetic resin and is provided with a bottom surface 35 having an opening. The lower housing 33 has a substantially box shape whose upper side is open. The lower housing 33 is fixed to a lower surface of the support base 34 in a state in which the head portion 110 is exposed downward from the opening of the bottom surface 35.

As shown in FIG. 3, the head portion 110 has a rectangular shape in a bottom view, and is provided such that it closes the opening of the bottom surface 35. The head portion 110 is formed by laminating stainless steel (SUS) plate shaped bodies in which fine holes are formed at positions corresponding to the plurality of nozzles 111. The head portion 110 is provided with the nozzle surface 112. The nozzle surface 112 is a surface having the plurality of nozzles 111 that can eject ink downward. The head portion 110 is supported from above by the lower housing 33 in a state in which the nozzle surface 112 is directed downward. The nozzle surface 112 is a surface that is parallel to the horizontal direction, and forms the bottom surface of each of the head units 100 and 200. The interior of the head portion 110 is divided into four sections along the left-right direction. Therefore, the head unit 200 can selectively eject each of the color inks that are different in color from each other. The plurality of nozzles 111 correspond to a plurality of ejection channels (not shown in the drawings) that are provided inside the head portion 110. When a plurality of piezoelectric elements (not shown in the drawings) provided inside the head portion 110 are driven, the plurality of ejection channels make it possible for the ink to be ejected downward from the plurality of nozzles 111 that respectively correspond to the ejection channels.

As shown in FIG. 4, the buffer tank 60 is formed in a hollow cuboid shape. In an upper portion of the head unit 100, the buffer tank 60 extends in parallel with the nozzle surface 112. The ink can be supplied to the head portion 110 after a pressure fluctuation of the ink is absorbed, by the buffer tank 60 temporarily storing the ink supplied from a main tank via tubes 25 and connection units 26. A tube joint 68 is provided on an upper surface of the buffer tank 60. End portions of the four flexible tubes 25 are respectively connected to the tube joint 68.

In the head unit 100, the four tubes 25, all of which supply the white ink to the buffer tank 60, are connected to the tube joint 68. In the head unit 200, the four tubes 25, which respectively supply the color inks of KYCM that are different in color from each other to the buffer tank 60, are connected to the tube joint 68. The connection units 26 are provided at the other end portions on an opposite side to the end portions of the respective four tubes 25. The connection units 26 connect the four tubes 25 with ink passages from the main tank (not shown in the drawings), which stores the ink on the right side of the housing 2. A vertical passage portion 61 is provided on a front end portion of the buffer tank 60. The vertical passage portion 61 extends in the up-down direction such that it couples the buffer tank 60 and the head portion 110. The interior of the vertical passage portion 61 is divided into four sections along the left-right direction. Therefore, in the head unit 200, the ink supplied from the four tubes 25 to the buffer tank 60 can be fed toward the head portion 110 for each of the KYCM colors. In addition, the head unit 100 is provided with a metal fin 90 and the like. The metal fin 90 is provided to radiate heat that is generated in the head portion 110 at the time of printing or the like.

Here, as shown in FIG. 3, the nozzle surface 112 has nozzle arrangements 121 to 124. Each of the nozzle arrangements 121 to 124 has a plurality of nozzle arrays. The nozzle arrays are arrays of the plurality of nozzles 111 that extend in the front-rear direction on the nozzle surface 112. The nozzle arrangement 121, the nozzle arrangement 122, the nozzle arrangement 123 and the nozzle arrangement 124 are arranged in that order from the left to the right. The ink supplied from the four tubes 25 to the buffer tank 60 is fed to each of the nozzle arrangements 121 to 124. More specifically, the nozzle arrangements 121 to 124 of the head unit 100 are nozzle arrangements that can respectively eject the white ink. The nozzle arrangements 121 to 124 of the head unit 200 can respectively eject the color inks that are different from each other. The nozzle arrangement 121 ejects the black ink, the nozzle arrangement 122 ejects the yellow ink, the nozzle arrangement 123 ejects the cyan ink and the nozzle arrangement 124 ejects the magenta ink, respectively.

Figure 5:
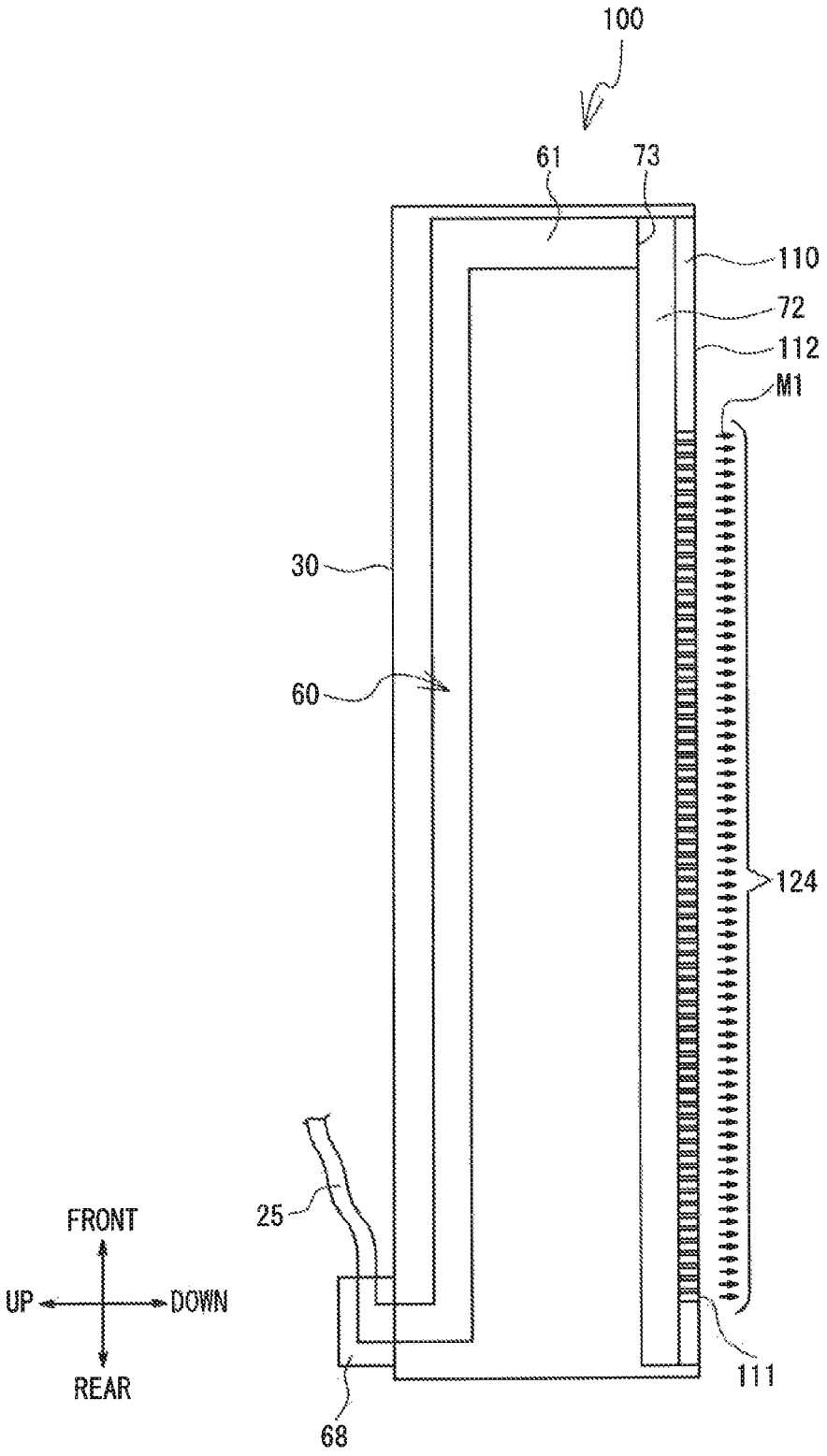
FIG. 5 is a schematic view showing a configuration of ink passages inside the head unit, and corresponding to a B-B cross section of the head unit shown in FIG. 3.

The configuration of the ink passages inside the head unit 100 will be explained with reference to FIG. 5 to FIG. 8. As shown in FIG. 5, the tubes 25 and the buffer tank 60 are connected by the tube joint 68. The vertical passage portion 61 is connected to the front end portion of the buffer tank 60. A lower end portion of the vertical passage portion 61 is connected to a supply passage 72 at a supply port 73 that is provided on a front end portion of the supply passage 72. The supply passage 72 is a passage to supply the ink supplied from the supply port 73 to the nozzle arrays, and extends in the front-rear direction in the head portion 110. FIG. 5 schematically shows a configuration example in which the ink that has been supplied via the tube 25 and the buffer tank 60 is supplied to the nozzle arrangement 124 via the supply passage 72. An arrow M1 shows a manner in which the ink supplied from the supply passage 72 to the nozzle arrangement 124 is ejected from each of the plurality of nozzles 111. In FIG. 5, in order to facilitate understanding of the manner in which the ink is ejected from the nozzles 111, a bore diameter of the nozzles 111 is shown larger than an actual bore diameter of the nozzles 111. In order to simplify the drawing, FIG. 5 shows a smaller number of the nozzles 111 than the number of the nozzles 111 that are actually provided on the head portion 110. The configuration in the vicinity of the nozzle arrays in each of the nozzle arrangements 121 to 123, namely, the configuration of the supply passage 72, the supply port 73 and a communication path 75 (which will be described later) is the same as that in the case of the nozzle arrangement 124. Therefore, in the explanation below, nozzle arrays L1 to L6 of the nozzle arrangement 124, the supply passage 72, the supply port 73 and the communication path 75 will be explained.

Figure 6:
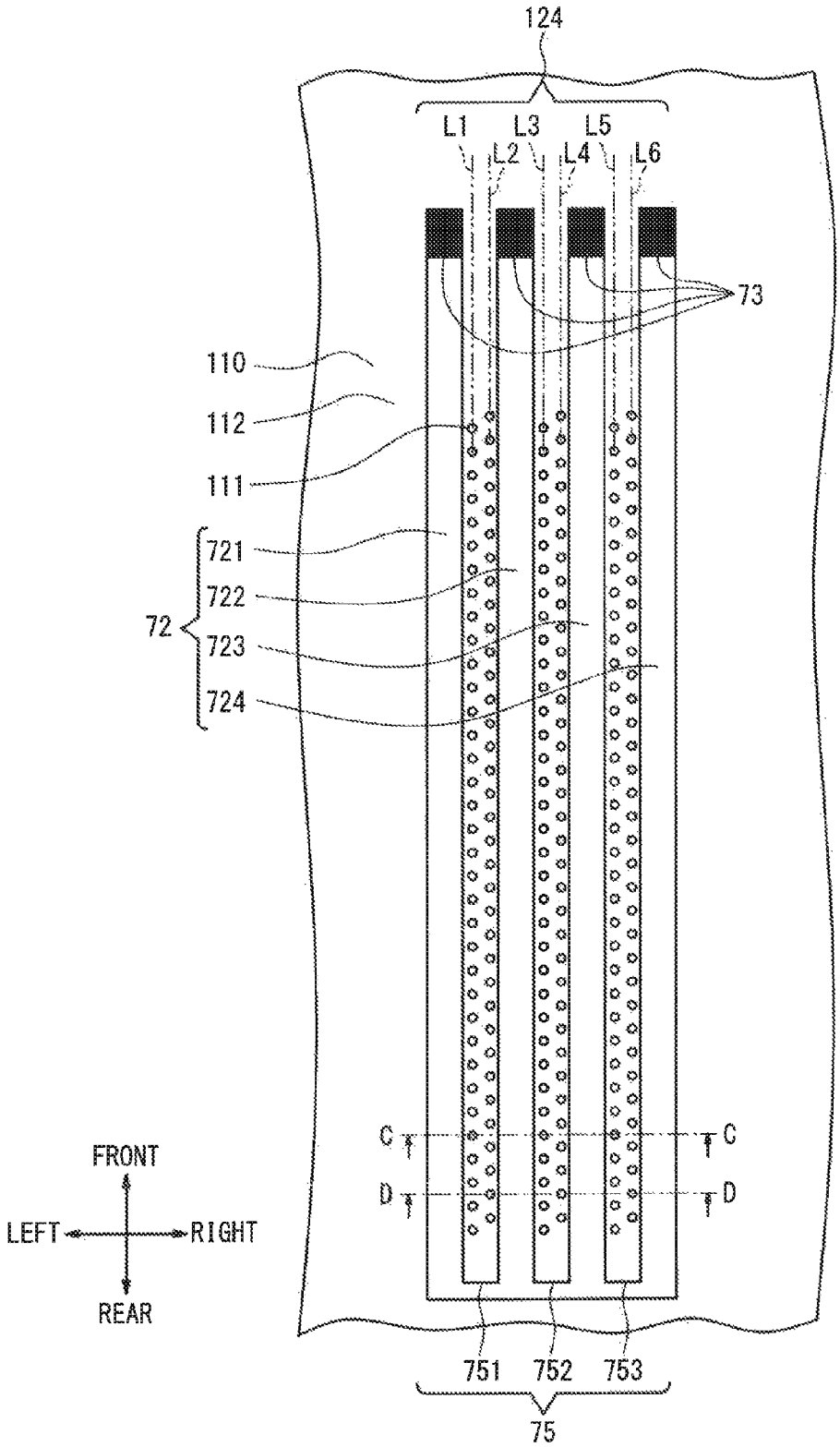
FIG. 6 is a schematic view showing the configuration of the ink passages when a head portion is seen from the side of a nozzle surface.

As shown in FIG. 6, the nozzle arrangement 124 is provided with the nozzle arrays L1 to L6. Each of the nozzle arrays L1 to L6 is an array of the plurality of nozzles 111 that are arranged side by side in the front-rear direction on the nozzle surface 112. The nozzle array L1, the nozzle array L2, the nozzle array L3, the nozzle array L4, the nozzle array L5 and the nozzle array L6 are arranged in that order from the left to the right. The nozzle array L1 and the nozzle array L2 are arranged adjacent to each other on the nozzle surface 112 such that the plurality of nozzles 111 included in the nozzle array L1 and the plurality of nozzles 111 included in the nozzle array L2 are arranged in a zigzag manner. The nozzle array L3 and the nozzle array L4 are also respectively arranged adjacent to each other, in the same manner as the nozzle array L1 and the nozzle array L2. The nozzle array L5 and the nozzle array L6 are also respectively arranged adjacent to each other, in the same manner as the nozzle array L1 and the nozzle array L2.

Figure 7:
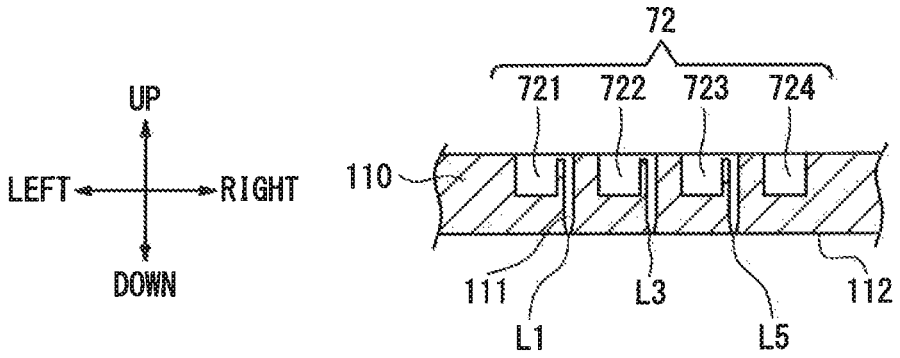
FIG. 7 is a cross-sectional view along C-C shown in FIG. 6.
Figure 8:
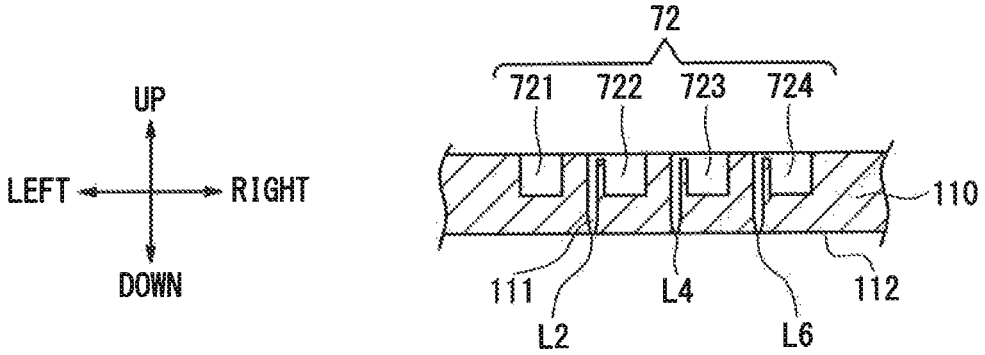
FIG. 8 is a cross-sectional view along D-D shown in FIG. 6.

In the head portion 110, the supply passage 72 includes supply passages 721 to 724 that extend along the nozzle arrays L1 to L6, respectively. The supply passages 721 to 724 are arranged from the left to the right in an order of the supply passage 721, the supply passage 722, the supply passage 723 and the supply passage 724. The supply passage 721 is arranged to the left of the nozzle array L1. The supply passage 722 is arranged between the nozzle array L2 and the nozzle array L3. The supply passage 723 is arranged between the nozzle array L4 and the nozzle array L5. The supply passage 724 is arranged to the right of the nozzle allay L6. As shown in FIG. 7 and FIG. 8, the supply passage 721 is connected with the nozzles 111 included in the nozzle array L1. The supply passage 722 is connected with the nozzles 111 included in the nozzle arrays L2 and L3. The supply passage 723 is connected with the nozzles 111 included in the nozzle arrays L4 and L5. The supply passage 724 is connected with the nozzles 111 included in the nozzle array L6. More specifically, the nozzle passage 721 is a passage to supply the ink to the nozzle array L1. The supply passage 722 is a passage to supply the ink to the nozzle arrays L2 and L3. The supply passage 723 is a passage to supply the ink to the nozzle arrays L4 and L5. The nozzle passage 724 is a passage to supply the ink to the nozzle array L6. In the explanation below, when the supply passages 721 to 724 are collectively referred to or when they are not particularly distinguished from each other, they are referred to as the supply passage 72 or the supply passages 72.

As shown in FIG. 6, the communication path 75 is provided such that rear end portions of the plurality of supply passages 72 are interconnected. The communication path 75 is provided with communication paths 751 to 753. The communication paths 751 to 753 are arranged from the left to the right in an order of the communication path 751, the communication path 752 and the communication path 753. The communication path 751 interconnects the rear end portion of the supply passage 721 and the rear end portion of the supply passage 722. The communication path 752 interconnects the rear end portion of the supply passage 722 and the rear end portion of the supply passage 723. The communication path 753 interconnects the rear end portion of the supply passage 723 and the rear end portion of the supply passage 724. In the explanation below, when the communication paths 751 to 753 are collectively referred to or when they are not particularly distinguished from each other, they are referred to as the communication path 75 or the communication paths 75.

The supply port 73 is provided at the front end portion of each of the supply passages 72. Therefore, it is likely that a necessary amount of ink for printing is sufficiently supplied to the nozzles 111 to which the ink is supplied from a section in the vicinity of the front end portion of each of the supply passages 72. It is more difficult for the ink supplied from the supply port 73 to reach the nozzles 111 to which the ink is supplied from a section in the vicinity of the rear end portion of each of the supply passages 72, because these nozzles 111 are farther from the supply port 73 in comparison to the nozzles 111 to which the ink is supplied from the section in the vicinity of the front end portion of each of the supply passages 72. Therefore, in the nozzles 111 to which the ink is supplied from the section in the vicinity of the rear end portion of each of the supply passages 72, there is a case in which the ink from each of the supply passages 72 is insufficient depending on an amount of ink required for printing. The communication paths 75 are provided to reduce the possibility of an insufficient supply of the ink occurring at the rear end portions of the supply passages 72. For example, when the ink is ejected from the nozzles 111 of the nozzle arrays L2 and L3 and the ink is not ejected from the other nozzle arrays L1, L4, L5 and L6, the ink in the supply passages 721 and 723 can flow into the rear end portion of the supply passage 722 via the communication paths 751 and 752. The communication paths 75 that interconnect the rear end portions of the plurality of supply passages 72 are provided so that the ink can be supplied to the rear end portion of one of the supply passages 72 from another of the supply passages 72. By doing this, the printer 1 reduces the possibility of an insufficient supply of the ink occurring at the rear end portions of the supply passages 72.

In the head portion 110, the supply passages 72, the supply ports 73 and the communication paths 75 are disposed above the nozzle surface 112 (refer to FIG. 5, FIG. 7 and FIG. 8). Therefore, when the head unit 100 is seen from the nozzle surface 112 side, the supply passages 72, the supply ports 73 and the communication paths 75 cannot actually be seen. In FIG. 6, the nozzle arrays L1 to L6, the supply passages 72, the supply ports 73 and the communication paths 75 are all shown in solid lines in order to explain positional relationships between the nozzle arrays L1 to L6, the supply passages 72, the supply ports 73 and the communication paths 75.

The configuration and maintenance operations of the maintenance portions 141 and 142 will be explained with reference to FIG. 2 and FIG. 9. The maintenance operations for the head units 100 and 200 are performed by the maintenance portions 141 and 142. Since the configuration and operations of the maintenance portion 141 are the same as those of the maintenance portion 142, an explanation of the maintenance portion 142 will be omitted as necessary in the explanation below.

Figure 9:
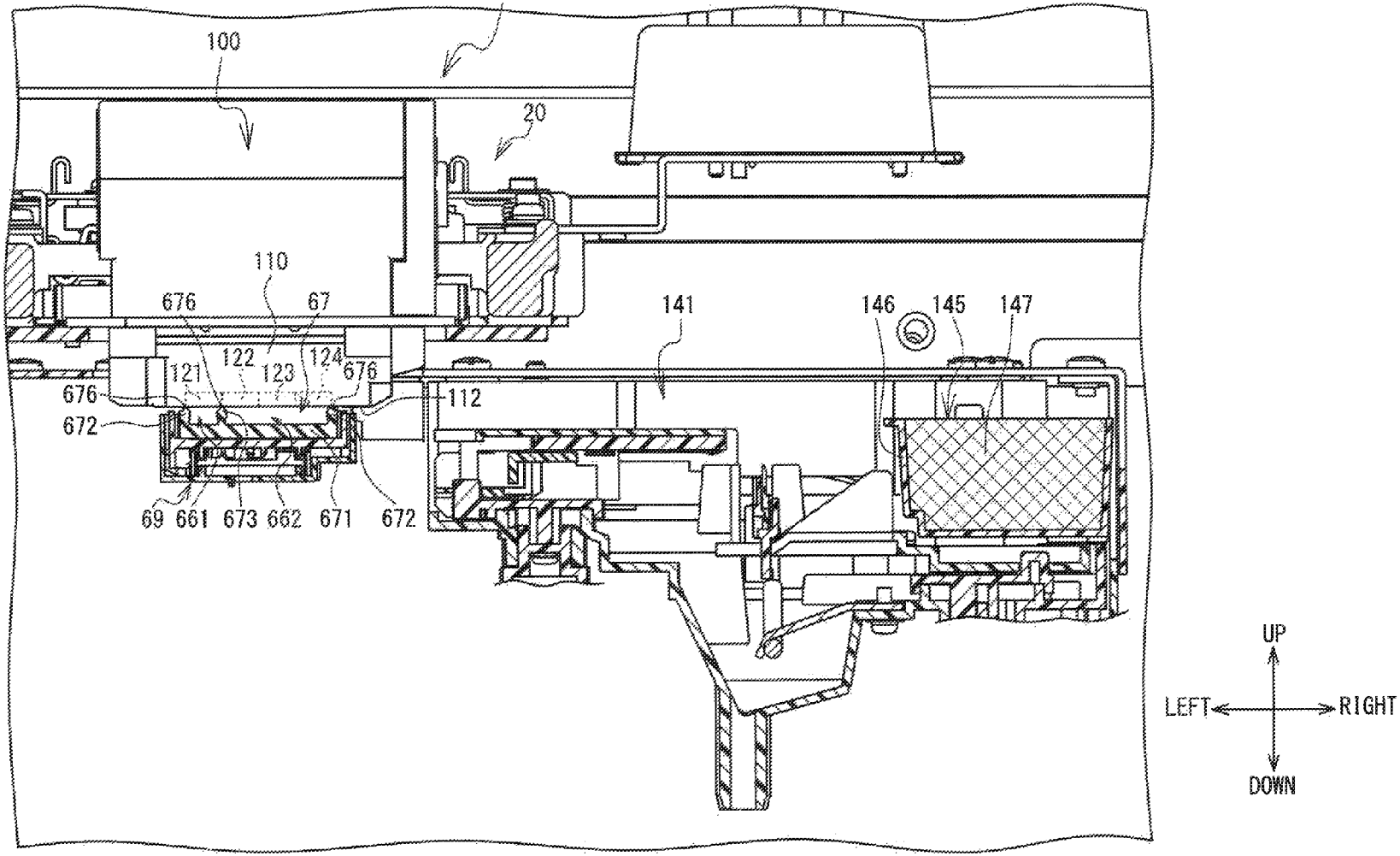
FIG. 9 is a cross-sectional view of the head unit along A-A shown in FIG. 2.

As shown in FIG. 2 and FIG. 9, the maintenance portion 141 is provided with the flushing reception portion 145, the cap 67 and a cap support portion 69. As shown in FIG. 2, the flushing reception portion 145 is a structure that is used for flushing, and is positioned in a right-side portion of the maintenance portion 141. The flushing reception portion 145 is provided with a container portion 146 and an absorber 147. The container portion 146 is a container that opens upward, and has a rectangular shape in a plan view. The absorber 147 is a cuboid-shaped member that can absorb the ink, and is disposed inside the container portion 146. The flushing reception portion 145 receives the ink ejected from the head unit 100 by the flushing. The ink received by the flushing reception portion 145 is absorbed by the absorber 147. The flushing is performed when the head unit 100 moves to a position above the flushing reception portion 145.

As shown in FIG. 9, the cap 67 and the cap support portion 69 are components that are used for purging, and are provided in a left-side portion of the maintenance portion 141. The cap 67 has a rectangular box shape in a plan view, and the upper side of the cap 67 is open. The cap 67 is disposed inside the cap support portion 69.

The cap 67 is made of a synthetic resin, such as silicon rubber, for example, and is provided with a bottom wall 671, a peripheral wall 672 and a partition wall 673. The bottom wall 671 is a plate-shaped wall portion that extends in the horizontal direction, and forms a lower portion of the cap 67. In a plan view, the bottom wall 671 has a rectangular shape along an inner surface of the cap support portion 69. The peripheral wall 672 is a wall portion that is provided on the upper side of the cap 67, which is the nozzle surface 112 side, and extends upward from the peripheral edge of the bottom wall 671. The peripheral wall 672 is provided such that, in the up-down direction, it faces the periphery of a region in which the plurality of nozzles 111 are provided on the nozzle surface 112. When the printing is not being performed, the cap 67 covers the nozzle surface 112 and blocks the plurality of nozzles 111 from the outside air. Thus, the cap 67 suppresses an increase in ink viscosity due to evaporation or the like of ink components inside the nozzles 111, and also plays a role in reducing the possibility of a print failure occurring.

The partition wall 673 is a wall portion that is provided on the upper side of the cap 67, which is the nozzle surface 112 side, and extends upward from the bottom wall 671. The partition wall 673 is provided between the center, in the left-right direction, of the bottom wall 671 and a left end portion of the bottom wall 671, and extends in the front-rear direction. The front end and the rear end of the partition wall 673 are each connected with the peripheral wall 672. Cap lips 676, which are the upper end of the peripheral wall 672 and the upper end of the partition wall 673, have the same height (namely, the same vertical position) across their entire length, and are positioned higher than the upper end of the cap support portion 69.

The cap support portion 69 moves in the up-down direction when it is driven by a cap drive portion 196 (refer to FIG. 10) that will be described later. The cap 67 moves in the up-down direction integrally with the cap support portion 69. As shown in FIG. 9, the cap 67 that has moved upward comes into close contact with the nozzle surface 112 of the head unit 100 that has moved to the non-print area 140. At this time, the cap lips 676 of the cap 67 come into close contact with the periphery of the region in which the plurality of nozzles 111 are provided on the nozzle surface 112, and the cap 67 covers the plurality of nozzles 111 of the nozzle surface 112. In the explanation below, the position of the cap 67 and the cap support portion 69 when the cap 67 is in close contact with the nozzle surface 112 is referred to as a cover position. The position of the cap 67 and the cap support portion 69 when the cap 67 is not in close contact with the nozzle surface 112 is referred to as a cap separation position. The maintenance portion 141 is provided with the suction pump 199 (refer to FIG. 10) connected to the cap 67. The suction pump 199 is provided such that it can generate a negative pressure in inner areas 661 and 662, which are inside the cap 67 in the covering position. When the cap 67 and the cap support portion 69 are in the cover position, the purging is performed. When the cap 67 and the cap support portion 69 are in the cap separation position, the flushing is performed.

Figure 10:
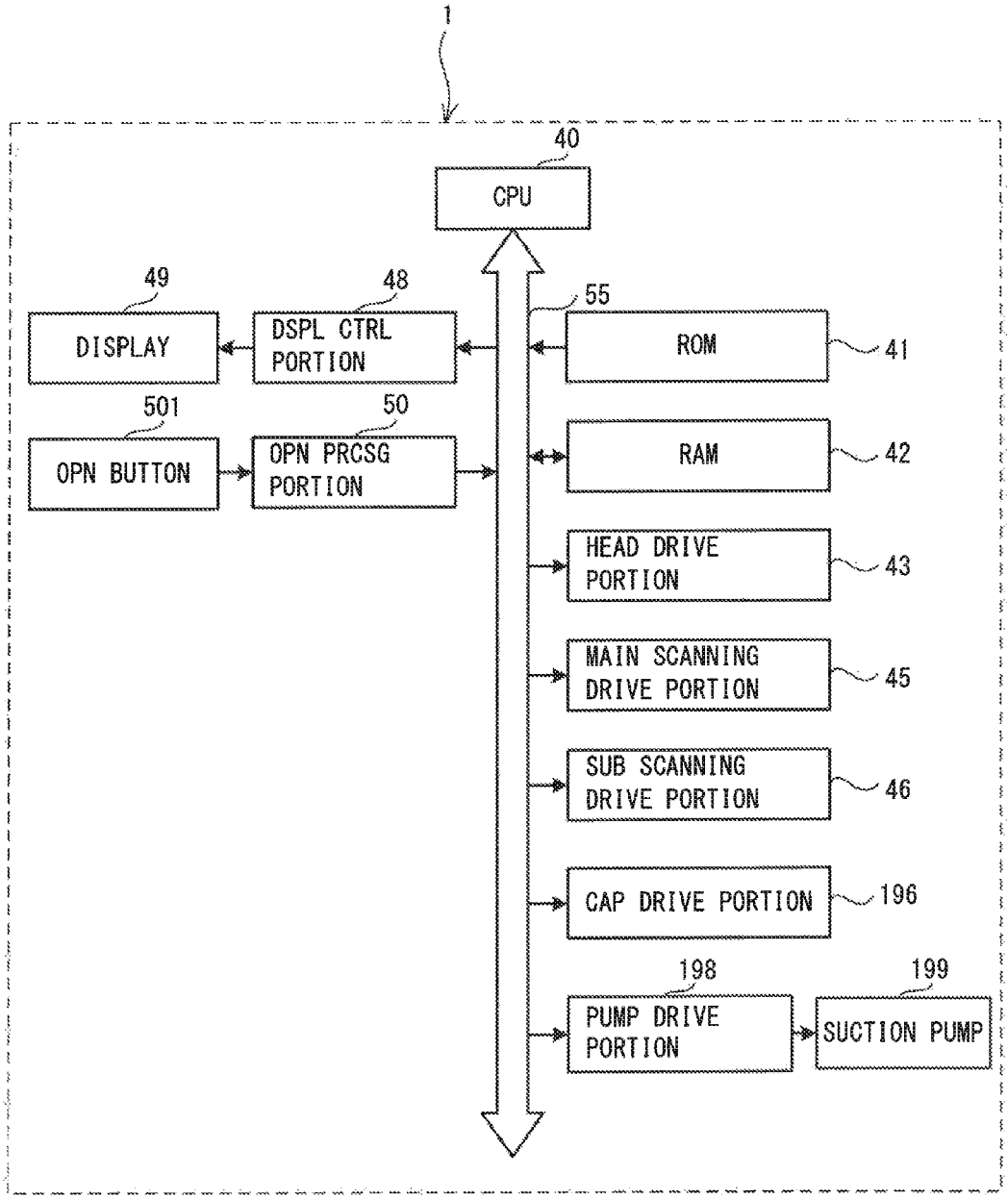
FIG. 10 is a block diagram showing an electrical configuration of the printer.

An electrical configuration of the printer 1 will be explained with reference to FIG. 10. The printer 1 is provided with the CPU 40 that controls the printer 1. The CPU 40 is electrically connected to a ROM 41, a RAM 42, a head drive portion 43, a main scanning drive portion 45, a sub-scanning drive portion 197, the cap drive portion 196, a pump drive portion 198, a display control portion 48 and an operation processing portion 50, via a bus 55.

The ROM 41 stores a control program to control operations of the printer 1 and initial values etc. The RAM 42 temporarily stores various types of data that are used in the control program. The head drive portion 43 is electrically connected to the head portion 110 that ejects the ink, and drives the piezoelectric elements provided in the respective ejection channels of the head portion 110 (refer to FIG. 3) so as to eject the ink from the nozzles 111.

The main scanning portion 45 includes the drive motor 19 (refer to FIG. 1) and moves the carriage 20 in the left-right direction (the scanning direction). The sub-scanning drive portion 46 includes a motor and a gear etc. that are not shown in the drawings, and drives the platen drive mechanism 6 (refer to FIG. 1), thereby moving the platen 5 (refer to FIG. 1) in the front-rear direction (the sub-scanning direction).

The cap drive portion 196 includes a cap drive motor (not shown in the drawings) and a gear etc., and moves the cap support portion 69 in the up-down direction, thereby moving the cap 67 in the up-down direction. Due to the drive of the cap drive portion 196, the cap support portion 69 of the maintenance portion 141 and the cap support portion 69 of the maintenance portion 142 move in the up-down direction at the same time. The pump drive portion 198 drives the suction pump 199. The display control portion 48 controls display of the display 49. The operation processing portion 50 outputs an operation input on the operation buttons 501 to the CPU 40.

Maintenance processing by the CPU 40 of the printer 1 will be explained with reference to FIG. 11 to FIG. 14. In the maintenance processing, processing to perform the flushing and the purging is performed. When the printing is not being performed, such as, for example, when the power source of the printer 1 is turned on, the CPU 40 operates based on the control program stored in the ROM 41. Thus, the CPU 40 controls the printer 1 and performs the maintenance processing shown in FIG. 11.

Figure 11:
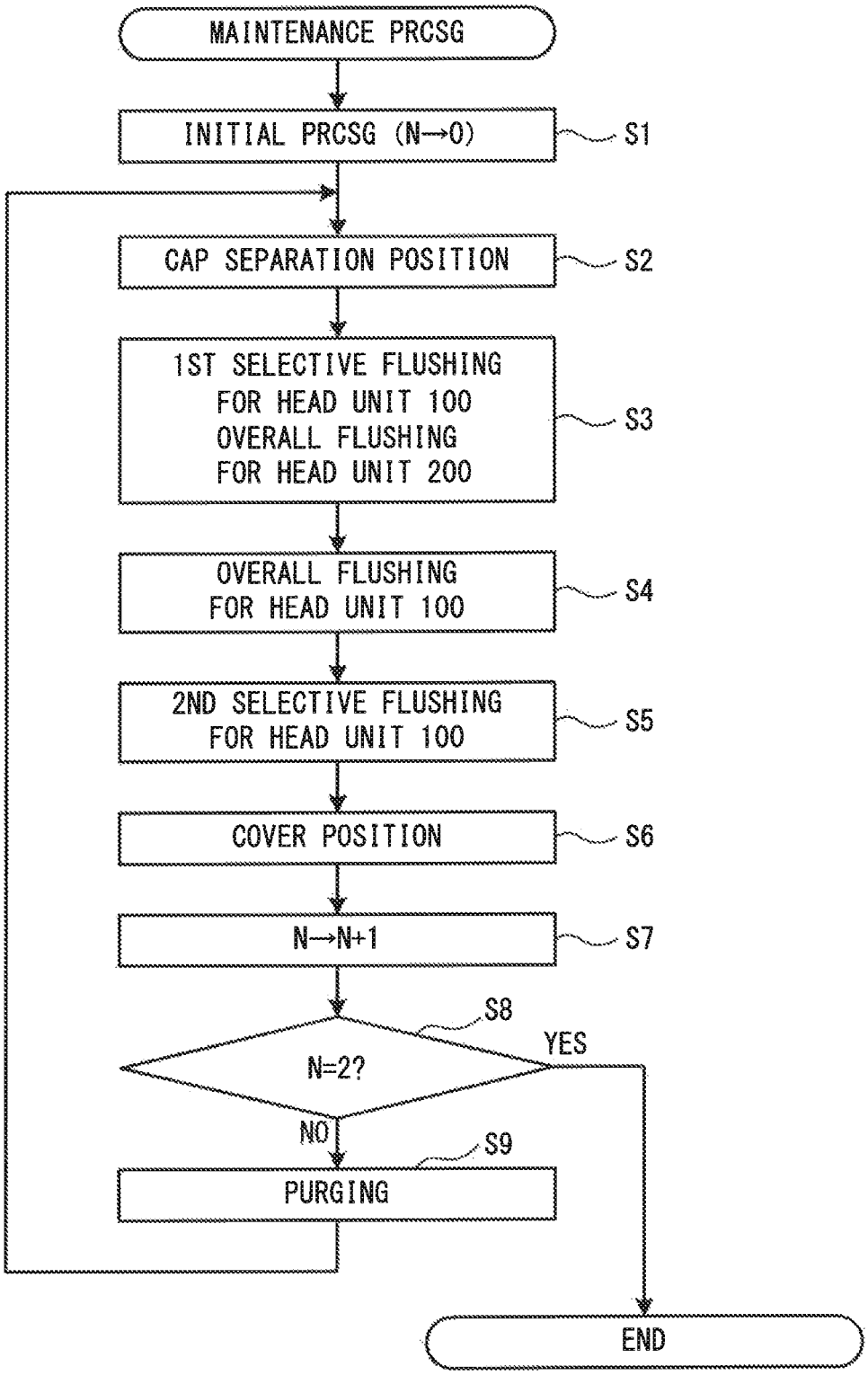
FIG. 11 is a flowchart of maintenance processing.

It is assumed that the cap 67 is in the cover position (refer to FIG. 9) before the maintenance processing is started. As shown in FIG. 11, when the maintenance processing is started, the CPU 40 performs the following initial processing (step S1). The CPU 40 clears the data stored in the RAM 42. Particularly, the CPU 40 clears the value of a counter N stored in the RAM 42 to be zero. The counter N is a counter to count the number of times a series of flushing operations (to be described later) is performed, and is stored in the RAM 42.

Next, the CPU 40 drives the cap drive portion 196 (refer to FIG. 10) and moves the cap support portion 69 downward, thereby moving the cap 67 from the cover position to the cap separation position (step S2). As a result, each of the head units 100 and 200 is set to a cover release state. The cover release state is a state in which the covering of the nozzle surface 112 by the cap 67 is released.

Next, the CPU 40 performs first selective flushing for the head unit 100, and performs overall flushing for the head unit 200 (step S3). In the present embodiment, in the flushing, a pulse drive signal of a drive frequency of 20 KHz, for example, is applied by the drive portion 43 to the piezoelectric elements, and thus the ink is ejected from the nozzles 111, at a rate of 20,000 times per second. The overall flushing is flushing that causes the ink to be ejected from all the nozzles 111 provided on the head unit 100 (200). The selective flushing is flushing that causes the ink to be ejected from the nozzles 111 included in some of the plurality of nozzle arrays provided on the head unit 100 (200). Particularly, the selective flushing of the present embodiment is flushing that causes the ink to be ejected from the nozzles 111 that are arranged in a region adjacent to the communication path 75. In the processing at step S3, the CPU 40 drives the head drive portion 43 and transmits a drive signal for two seconds to the piezoelectric elements provided in the ejection channels that correspond to the nozzles 111 arranged in a first region E1 of the head portion 110 of the head unit 100. By doing this, the printer 1 performs the first selective flushing for the head unit 100. Further, in the processing at step S3, the CPU 40 drives the head drive portion 43 and transmits a drive signal for two seconds, for example, to all the piezoelectric elements provided in each of the ejection channels of the head portion 110 of the head unit 200. In this manner, the CPU 40 performs the overall flushing for the head unit 200.

Figure 12:
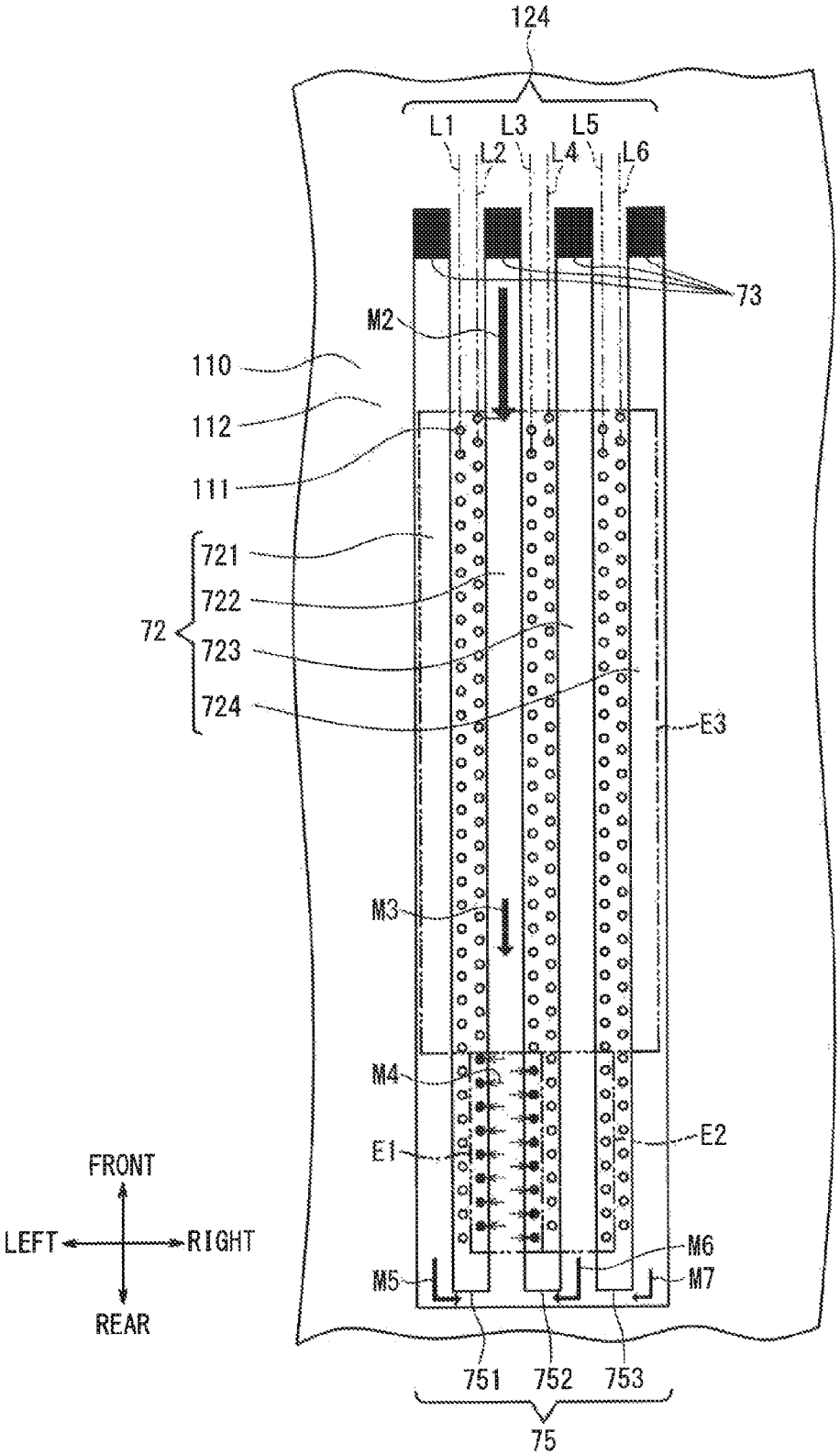
FIG. 12 is a schematic view showing a state in which first selective flushing is performed in the head portion.

The selective flushing of the present embodiment includes two ways of flushing, namely, the first selective flushing and second selective flushing. As shown in FIG. 12, in the first selective flushing, the flushing is performed for the nozzles 111 included in the nozzle arrays L2 and L3 among the nozzle allays L1 to L6. In FIG. 12, white circles show the nozzles 111 that do not eject ink in the first selective flushing. Black circles show the nozzles 111 that eject ink in the first selective flushing. As illustrated in FIG. 13 to FIG. 16 also, the nozzles 111 that do not eject ink are denoted by white circles and the nozzles 111 that eject ink are denoted by black circles, respectively. In the present embodiment, in the first selective flushing, the ink is ejected from the nozzles 111 arranged in the first region E1, among the nozzles 111 included in the nozzle arrays L2 and L3. The first region E1 is a region of the nozzle arrays L2 and L3, and corresponds to the rear end side of the supply passage 722 that is adjacent to the communication paths 75. Among the nozzles 111 included in the nozzle arrays L2 and L3, the ink is not ejected from the nozzles 111 arranged in a third region E3, which is a region on the front end side of the supply passages 72 (the side on which the supply ports 73 are disposed) with respect to the first region E1.

When the first selective flushing is performed, the ink is supplied from the supply passage 722 to the nozzles 111 arranged in the first region E1 in the nozzle arrays L2 and L3. At this time, the flow of ink shown by an arrow M2 is generated in the vicinity of the supply port 73 of the supply passage 722. The ink supplied from the supply port 73 to the supply passage 722 is supplied to the nozzles 111 arranged on the rear end side of the supply passage 722 (refer to arrows M4) while the flow rate of the ink is gradually reduced as the ink flows farther away from the supply port 73 of the supply passage 722 (refer to an arrow M3). The size of each of the arrow M2 and the arrow M3 schematically shows the speed of the ink flow.

When the ink is ejected from the nozzles 111 arranged in the first region E1 in the nozzle arrays L2 and L3, the ink in the rear end side of the supply passage 722 decreases and a negative pressure is generated in the rear end side of the supply passage 722. Due to the negative pressure, the ink is drawn from the supply port 73 of the supply passage 722, and thus the ink is supplied to the supply passage 722. At this time, the ink is not ejected from the nozzle arrays L1 and L4 to L6, and therefore, the ink is stored in the supply passages 721, 723 and 724 such that the supply passages 721, 723 and 724 are substantially filled with the ink. The ink stored in the supply passages 721, 723 and 724 is drawn via the communication paths 75 due to the negative pressure generated in the rear end side of the supply passage 722, and flows toward the supply passage 722 (refer to arrows M5, M6 and M7). The supply passage 724 is disposed farther from the supply passage 722 than the supply passages 721 and 723. Therefore, the flow of the ink (refer to the arrows M5 and M6) that flows from the supply passages 722 and 724 toward the supply passage 722 via the communication paths 751 and 752 is greater than the flow of the ink (refer to the arrow M7) that flows from the supply passage 724 toward the supply passage 722 via the communication path 753.

As described above, it is likely that the ink flow in the rear end side of the supply passages 72 is slower than in the front end side. When the ink flow in the rear end side of the supply passages 72 stagnates, the ink flow between the supply passages 72 via the communication paths 75 also tends to stagnate. When the fluidity of the ink decreases in the supply passages 72 in the vicinity of the communication paths 75 and in the communication paths 75, there is a possibility that, particularly with respect to the white ink, pigment particles will sediment in the communication paths 75 and in the vicinity of the communication paths 75 and will cause clogging of the ink. In the present embodiment, by performing the first selective flushing, the ink flows into the supply passage 722 from each of the supply passages 721, 722 and 724 via each of the communication paths 751, 752 and 753. Therefore, the printer 1 can improve the fluidity of the ink in the supply passages 72 in the vicinity of the communication paths 75 and in the communication paths 75. As a result of the improvement in the fluidity of the ink, the ink is agitated in the communication paths 75 and in the vicinity of the communication paths 75 and it is possible to inhibit the pigment particles from sedimentation. Thus, the printer 1 can reduce a deterioration in the print quality caused by the clogging of the ink.

The CPU 40 performs the overall flushing for the head unit 200. Ink particles of the color inks ejected from the head unit 200 are more unlikely to sediment than ink particles of the white ink. Therefore, the selective flushing need not necessarily be performed in the head unit 200. However, while a series of flushing operations is performed for the head unit 100, the cap 67 is in the cover release state with respect to the head unit 200. Therefore, there is a possibility that the viscosity of the color inks in the head portion 110 of the head unit 200 will increase due to drying out. In this case, the ejection performance of the ink in the head unit 200 may deteriorate or an ejection failure of the ink may occur. In order to avoid this type of problem, the printer 1 performs the overall flushing for the head unit 200 while the first selective flushing is being performed for the head unit 100, thus inhibiting the drying of the ink in the head unit 200. In the overall flushing, the ink is ejected from all of the nozzles 111 included in the nozzle arrays L1 to L6, as shown in FIG. 13.

In the present embodiment, after that, the overall flushing is also performed for the head unit 100, as will be described later. The printer 1 avoids performing the overall flushing simultaneously for the head unit 100 and the head unit 200. It is thus possible to reduce the number of the piezoelectric elements that are simultaneously driven by the printer 1, and to suppress a peak in the power consumption of the printer 1.

The explanation returns to FIG. 11. Next, the CPU 40 drives the head drive portion 43 and transmits a drive signal for two seconds to all of the piezoelectric elements provided in each of the ejection channels of the head portion 110 of the head unit 100, thus performing the overall flushing for the head unit 100 (step S4). By this processing, in the head unit 100, the ink is ejected from all of the nozzles 111 included in the nozzle arrays L1 to L6, as shown in FIG. 13. In the first selective flushing, the ink is ejected from the nozzles 111 in the first region E1. In the second selective flushing, which will be described later, the ink is ejected from the nozzles 111 in a second region E2. In the overall flushing, the ink is ejected not only from the nozzles 111 in the first region E1 and the second region E2, from which the ink is ejected by the first and second selective flushing, but also from the nozzles 111 in the third region E3, from which the ink is not ejected by the first and second selective flushing. In the nozzle arrays L1 to L6, the third region E3 is a region on the front end side of the supply passages 72 (the side on which the supply ports 73 are disposed) with respect to the first region E1 and the second region E2. By performing the processing at step S4, the CPU 40 also causes the ink to be ejected from the nozzles 111 from which the ink is not ejected by the first and second selective flushing. Therefore, the printer 1 can inhibit drying out of the ink in all the nozzles 111 provided on the head unit 100, and can sufficiently restore the ink ejection performance of the head unit 100.

Figure 13:
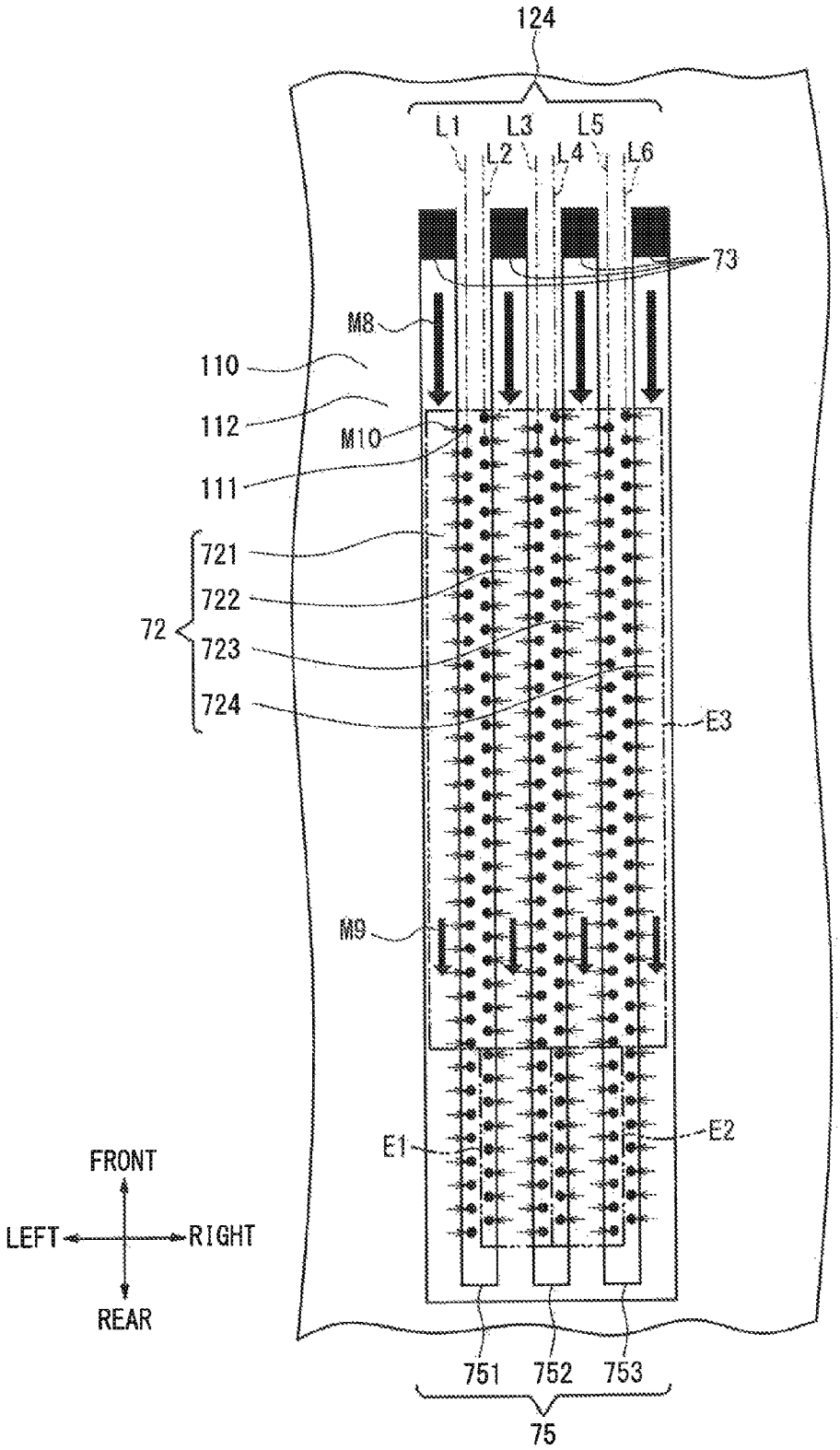
FIG. 13 is a schematic view showing a state in which overall flushing is performed in the head portion.

As shown in FIG. 13, when the overall flushing is performed, the ink flow shown by arrows M8 is generated in the vicinity of the supply port 73 of each of the supply passages 721 to 724. In addition, with respect to the ink supplied from the supply ports 73 to the supply passages 721 to 724, the ink flow that attenuates as the ink flows away from the supply ports 73 is also generated as shown by arrows M9. In the overall flushing, the ink is ejected uniformly from each of the nozzles 111 included in the nozzle arrays L1 to L6 (refer to arrows M10). Therefore, a bias in ink pressure is unlikely to occur in the rear end side of each of the supply passages 721 to 724. Thus, the ink flow is unlikely to be generated between the supply passages 72 via the communication paths 75. The printer 1 performs the overall flushing after performing the first selective flushing for the head unit 100, and can thus attenuate or temporarily stop the ink flow generated in the communication paths 75 by the first selective flushing. Effects that are caused by attenuating or temporarily stopping the ink flow generated in the communication paths 75 will be described in detail later.

Figure 14:
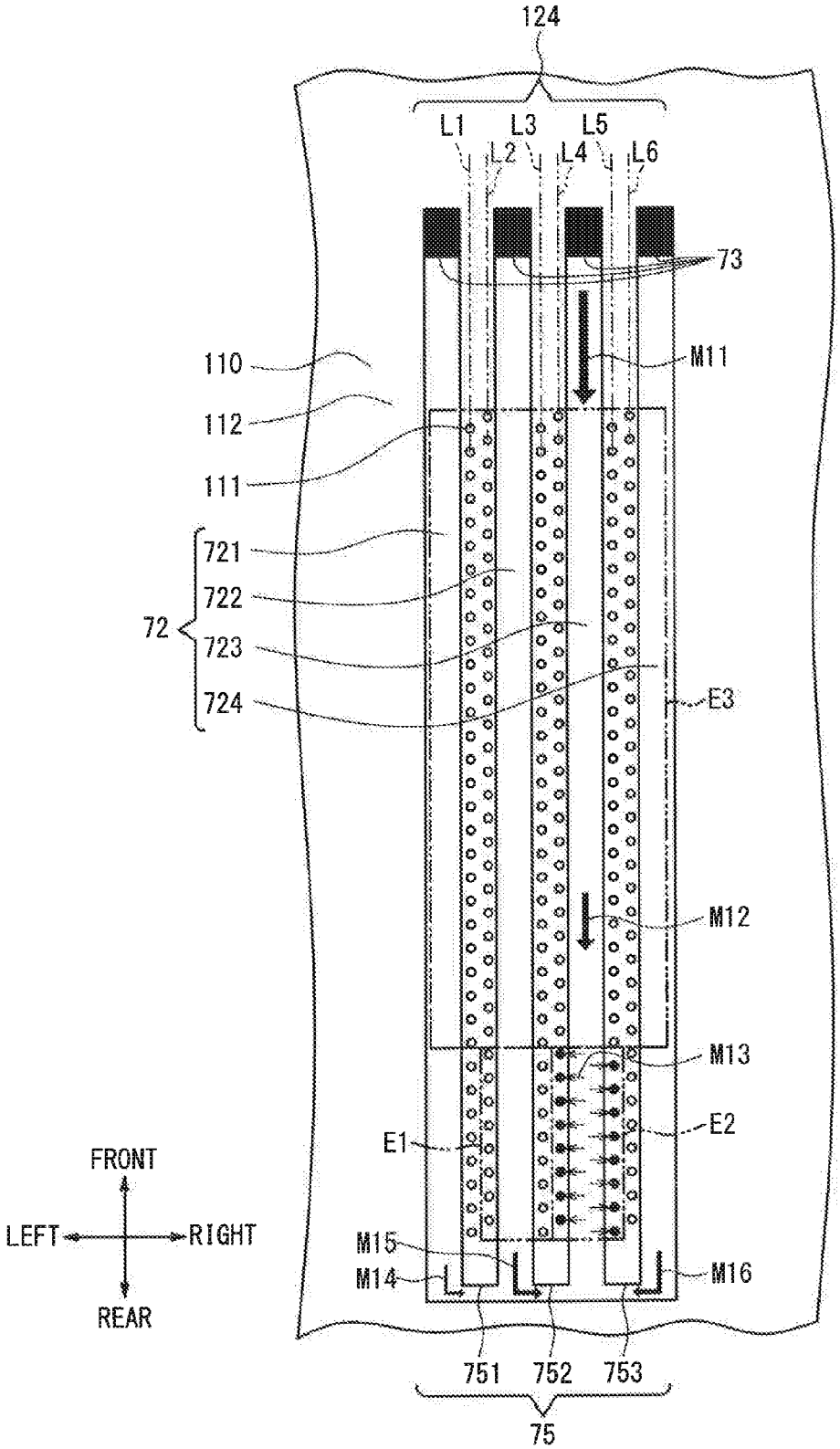
FIG. 14 is a schematic view showing a state in which second selective flushing is performed in the head portion.

The explanation returns to FIG. 11. Next, the CPU 40 performs the second selective flushing for the head unit 100 (step S5). As shown in FIG. 14, in the second selective flushing, the flushing is performed for the nozzles 111 included in the nozzle arrays L4 and L5 among the nozzle arrays L1 to L6. In the present embodiment, in the second selective flushing, the ink is ejected from the nozzles 111 arranged in the second region E2, among the nozzles 111 included in the nozzle arrays L4 and L5. The second region E2 is a region of the nozzle arrays L4 and L5, and corresponds to the rear end side of the supply passage 723 that is adjacent to the communication paths 75. Among the nozzles 111 included in the nozzle arrays L4 and L5, the ink is not ejected from the nozzles 111 arranged in the third region E3. In the processing at step S5, the CPU 40 drives the head drive portion 43 and transmits a drive signal for two seconds to the piezoelectric elements provided in the ejection channels that correspond to the nozzles 111 arranged in the second region E2 of the head portion 110 of the head unit 100. By doing this, the printer 1 performs the second selective flushing for the head unit 100.

As shown in FIG. 14, in the second selective flushing, the selective flushing is performed on the nozzle arrays L4 and L5, which are nozzle arrays different from the nozzle arrays L2 and L3 on which the first selective flushing has been performed. When the second selective flushing is performed, the ink is supplied from the supply passage 723 to the nozzles 111 arranged in the second region E2 in the nozzle arrays L4 and L5. At this time, the ink flow shown by an arrow M11 is generated in the vicinity of the supply port 73 of the supply passage 723. The ink supplied from the supply port 73 to the supply passage 723 is supplied to the nozzles 111 arranged in the rear end side of the supply passage 723 (refer to arrows M13) while the flow rate of the ink gradually attenuates as the ink flows away from the supply port 73 of the supply passage 723 (refer to an arrow M12).

When the ink is ejected from the nozzles 111 arranged in the second region E2 in the nozzle arrays L4 and L5, the ink in the rear end side of the supply passage 723 decreases and a negative pressure is generated in the rear end side of the supply passage 723. Due to the negative pressure, the ink is drawn from the supply port 73 of the supply passage 723, and thus the ink is supplied to the supply passage 723. At this time, the ink is not ejected from the nozzle arrays L1 to L3 and L6, and therefore, the ink is stored in the supply passages 721, 722 and 724 such that the supply passages 721, 722 and 724 are substantially filled with the ink. The ink stored in the supply passages 721, 722 and 724 is drawn via the communication paths 75 due to the negative pressure generated in the rear end side of the supply passage 723, and flows toward the supply passage 723 (refer to arrows M14, M15 and M16). The supply passage 721 is disposed farther from the supply passage 723 than the supply passages 722 and 724. Therefore, the flow of the ink (refer to the arrows M15 and M16) that flows from the supply passages 722 and 724 toward the supply passage 723 via the communication paths 752 and 753 is greater than the flow of the ink (refer to the arrow M14) that flows from the supply passage 721 toward the supply passage 723 via the communication path 751. In the present embodiment, by performing the second selective flushing, the ink flows into the supply passage 723 from each of the supply passages 721, 722 and 724 via each of the communication paths 751, 752 and 753. Therefore, it is possible to improve the fluidity of the ink in the communication paths 75 and in the vicinity of the communication paths 75.

In the first selective flushing, as shown in FIG. 12, the ink in the supply passage 723 flows toward the supply passage 722 via the communication path 752. At this time, a leftward ink flow is generated in the communication path 752 (refer to the arrow M6). Further, in the second selective flushing, as shown in FIG. 14, the ink in the supply passage 722 flows toward the supply passage 723 via the communication path 752. At this time, a rightward ink flow is generated in the communication path 752 (refer to the arrow M15). Since the flushing is performed for the nozzle arrays that are different between the first selective flushing and the second selective flushing, the flows of the ink in the different directions are generated in the communication path 752. If clogging of the ink has occurred in the communication path 752, the printer 1 can effectively eliminate the clogging of the communication path 752 by generating the flows of the ink in the different directions in the communication path 752.

For example, a case is assumed in which the overall flushing is not performed between the execution of the first selective flushing and the execution of the second selective flushing. In this case, the leftward ink flow generated in the communication path 752 by the first selective flushing and the rightward ink flow generated by the subsequent second selective flushing interact so as to cancel each other out. Meanwhile, in the present embodiment, the leftward ink flow generated in the communication path 752 by the first selective flushing is attenuated or temporarily stopped by the execution of the subsequent overall flushing. Therefore, when the subsequent second selective flushing is performed, the rightward ink flow is effectively generated in the communication path 752. By performing the overall flushing between the execution of the first selective flushing and the execution of the second selective flushing, the printer 1 can alternately generate the ink flows in the different directions in the communication path 752 and can thus effectively eliminate the clogging of the communication path 752.

The nozzle array L3 on which the first selective flushing is performed is arranged adjacent to the nozzle array L4 on which the second selective flushing is performed. In other words, the first region E1 and the second region E2 are arranged adjacent to each other. In this case, the ink flows in the same directions as the ink flows shown by the arrow M5 and the arrow M7 (refer to FIG. 12) generated in the communication paths 751 and 753 by the first selective flushing are generated by the execution of the second selective flushing (refer to the arrow M14 and the arrow M16 in FIG. 14). In other words, an ink flow in the same direction is repeatedly generated in each of the communication paths 751 and 753. Therefore, a large ink flow tends to be generated in each of the communication paths 751 and 753. Due to the generation of the large ink flow, the printer 1 can effectively eliminate the clogging of the communication paths 751 and 753.

In the present embodiment, the first selective flushing, the second selective flushing and the overall flushing that are performed for the head units 100 and 200 by the processing at step S3 to step S5 are collectively referred to as a series of flushing operations.

The explanation returns to FIG. 11. Next, the CPU 40 drives the cap drive portion 196 (refer to FIG. 10) and moves the cap support portion 69 upward, thereby moving the cap 67 from the cap separation position to the cover position (step S6). As a result, each of the head units 100 and 200 is set to a cover state in which the cap 67 covers the nozzle surface 112 (refer to FIG. 9).

Next, the CPU 40 adds "1" to the counter N stored in the RAM 42 (step S7). The CPU 40 refers to the value of the counter N and determines whether or not the value referred to is "2" (step S8). When the value of the counter N is not "2" (no at step S8), the CPU 40 drives the pump drive portion 198 (refer to FIG. 10) and causes the suction pump 199 (refer to FIG. 10) to operate (step S9). The suction pump 199 sucks air from the inner areas 661 and 662 (refer to FIG. 9) of the cap 67 in the cover state, and thus a negative pressure is applied to the inner areas 661 and 662. As a result of this, the ink is drawn from the inside of the nozzles 111 of the head units 100 and 200. Thus, the purging is performed for the head portion 110 of each of the head units 100 and 200. After that, the processing from step S2 to step S7 is repeatedly performed. On the other hand, when the value of the counter N is "2" (yes at step S8), the CPU 40 ends the maintenance processing.

In this manner, the printer 1 first performs the series of flushing operations, and can thus improve the fluidity of the ink in the supply passages 72 and the communication paths 75 and can reduce ejection failures of the ink. After that, by performing the purging, the printer 1 forcibly discharges from the head portion 110 the ink containing foreign matter or air bubbles etc. that could not be eliminated by the series of flushing operations, and can thus improve the print quality. After that, by performing the series of flushing operations once more, the printer 1 can further improve the fluidity of the ink in the supply passages 72 and the communication paths 75. At the same time, the printer 1 can optimize the meniscus of the nozzles 111 and can sufficiently restore the print quality.

As explained above, the head portion 110 of each of the head units 100 and 200 of the printer 1 is provided with the supply passages 721 to 724 that extend along each of the nozzle arrays L1 to L6. The front end portions of the supply passages 721 to 724 are respectively provided with the supply ports 73 to supply the ink to the supply passages 721 to 724. The rear end portions of the supply passages 721 to 724 are provided with the communication paths 751 to 753 that interconnect the supply passages 721 to 724. The communication paths 75 are provided on the rear end portions of the supply passages 72, which are on the opposite side to the front end portions where the supply ports 73 are provided. It is therefore likely that the ink flow is slower in the supply passages 72 in the vicinity of the communication paths 75 and in the communication paths 75 than in the supply passages 72 in the vicinity of the supply ports 73. In the printer 1, the first selective flushing is performed on the nozzle arrays L2 and L3 to which the ink is supplied from the supply passage 722, which is a part of the supply passages 72. At this time, the supply passages 721, 723 and 724 through which the ink is supplied to the nozzle arrays L4 to L5, on which the first selective flushing is not performed, are substantially filled with the ink. The ink stored in the supply passages 721, 723 and 724 flows toward the supply passage 722 via the communication paths 751, 752 and 753 as a result of the first selective flushing that is performed on some of the nozzle arrays (refer to the arrows M5, M6 and M7 in FIG. 12). Thus, the printer 1 can improve the fluidity of the ink in the communication paths 75 and in the vicinity of the communication paths 75. Due to the improvement in the fluidity of the ink, the ink in the communication paths 75 and in the vicinity of the communication paths 75 is agitated, and it is possible to inhibit the pigment particles from sedimentation. The printer 1 can reduce deterioration in the print quality due to the clogging of the ink in the supply passages 72 in the vicinity of the communication paths 75 and in the communication paths 75, where the fluidity of the ink tends to stagnate.

After performing the first selective flushing, the printer 1 performs the second selective flushing on the nozzles 111 arranged in the second region E2 of the nozzle arrays L4 and L5, which are nozzle arrays different from the nozzle arrays L2 and L3 on which the first selective flushing has been performed. The second region E2 is a region of the nozzle arrays L4 and L5, and corresponds to the rear end side of the supply passage 723 that is adjacent to the communication paths 75. Therefore, the printer 1 can effectively eliminate the clogging of the ink in the communication path 752.

In the printer 1, the first region E1 and the second region E2 are arranged adjacent to each other. In this case, the ink flows in the same directions as the ink flows shown by the arrow M5 and the arrow M7 (refer to FIG. 12) generated in the communication paths 751 and 753 by the first selective flushing are generated by the execution of the second selective flushing (refer to the arrow M14 and the arrow M16 in FIG. 14). In other words, an ink flow in the same direction is repeatedly generated in each of the communication paths 751 and 753. Therefore, the printer 1 can effectively improve the fluidity of the ink in the communication paths 751 and 753.

In addition to the first and second selective flushing (refer to step S3 and step S5 in FIG. 11), the CPU 40 performs the overall flushing (refer to step S4 in FIG. 11) for the head unit 100. In the overall flushing, by performing the processing at step S4, the CPU 40 can also cause the ink to be ejected from the nozzles 111 that are arranged in the third region E3 from which the ink is not ejected by the first and second selective flushing. Therefore, the printer 1 can sufficiently restore the ink ejection performance of the head unit 100.

When the overall flushing is performed, the ink flow is unlikely to be generated between the supply passages 721 to 724 via the communication paths 75. By the first selective flushing, the printer 1 can generate the leftward ink flow in the communication path 752 (refer to the arrow M6 in FIG. 12). After performing the first selective flushing, the printer 1 performs the overall flushing for the head unit 100, and can thus attenuate or temporarily stop the ink flow shown by the arrow M6. After that, by performing the second selective flushing, the printer 1 can effectively generate the rightward ink flow in the communication path 752. More specifically, the printer 1 alternately generates the ink flows in the different directions in the communication path 752, and can thus effectively eliminate the clogging of the communication path 752.

By performing the series of flushing operations, the printer 1 can improve the fluidity of the ink in the supply passages 72 and the communication paths 75 of the head unit 100, and can reduce ejection failures of the ink. After that, the printer 1 performs the purging for the head unit 100. Therefore, the printer 1 can forcibly discharge the ink containing foreign matter or air bubbles etc. that could not be eliminated by the series of flushing operations, and can thus improve the print quality. After performing the purging, the printer 1 further performs the series of flushing operations. Therefore, the printer 1 can further improve the fluidity of the ink in the supply passages 72 and the communication paths 75. At the same time, the printer 1 can optimize the meniscus of the nozzles 111 and can sufficiently restore the print quality.

The printer 1 is provided with the head unit 100 that ejects the white ink and the head unit 200 that ejects the color inks. The white ink contains titanium oxide as a pigment. The titanium oxide is an inorganic pigment having a relatively high specific gravity. Therefore, when the white ink is not sufficiently agitated, it is likely that the pigment particles sediment in the supply passages 72 and the communication paths 75. Although the color ink also contains a pigment, the pigment contained in the color ink is less likely to sediment compared to titanium oxide. The printer 1 performs the first and second selective flushing for the head unit 100 that ejects the white ink. Therefore, even when the pigment particles sediment inside the head portion 110 of the head unit 100, it is possible to improve the ink ejection performance of the head unit 100.

The CPU 40 performs the first selective flushing for the head unit 100, and also performs the overall flushing for the head unit 200 (refer to step S3 in FIG. 11). Thus, in comparison to a case in which, for example, the printer 1 performs the overall flushing for both the head units 100 and 200 at the same time, it is possible to reduce the number of the piezoelectric elements that are driven at the same time. It is therefore possible to suppress the peak in the power consumption of the printer 1. Further, while the series of flushing operations is being performed, the cap 67 is in the cover release state with respect to the head unit 200. The printer 1 performs the overall flushing for the head unit 200 while the first selective flushing is being performed for the head unit 100, and can thus inhibit the drying out of the ink in the head unit 200.

The present disclosure is not limited to the above-described embodiment. For example, in the above-described embodiment, in the first selective flushing, the flushing is performed for the nozzles 111 included in the nozzle arrays L2 and L3 among the nozzle arrays L1 to L6 (refer to FIG. 12). In the second selective flushing, the flushing is performed for the nozzles 111 included in the nozzle arrays L4 and L5 among the nozzle arrays L1 to L6 (refer to FIG. 12). It is sufficient that the nozzle arrays on which the flushing is performed in the first and second selective flushing are nozzle arrays that receive the supply of the ink from a part of the plurality of supply passages 72. Hereinafter, a modified example will be explained.

Figure 15:
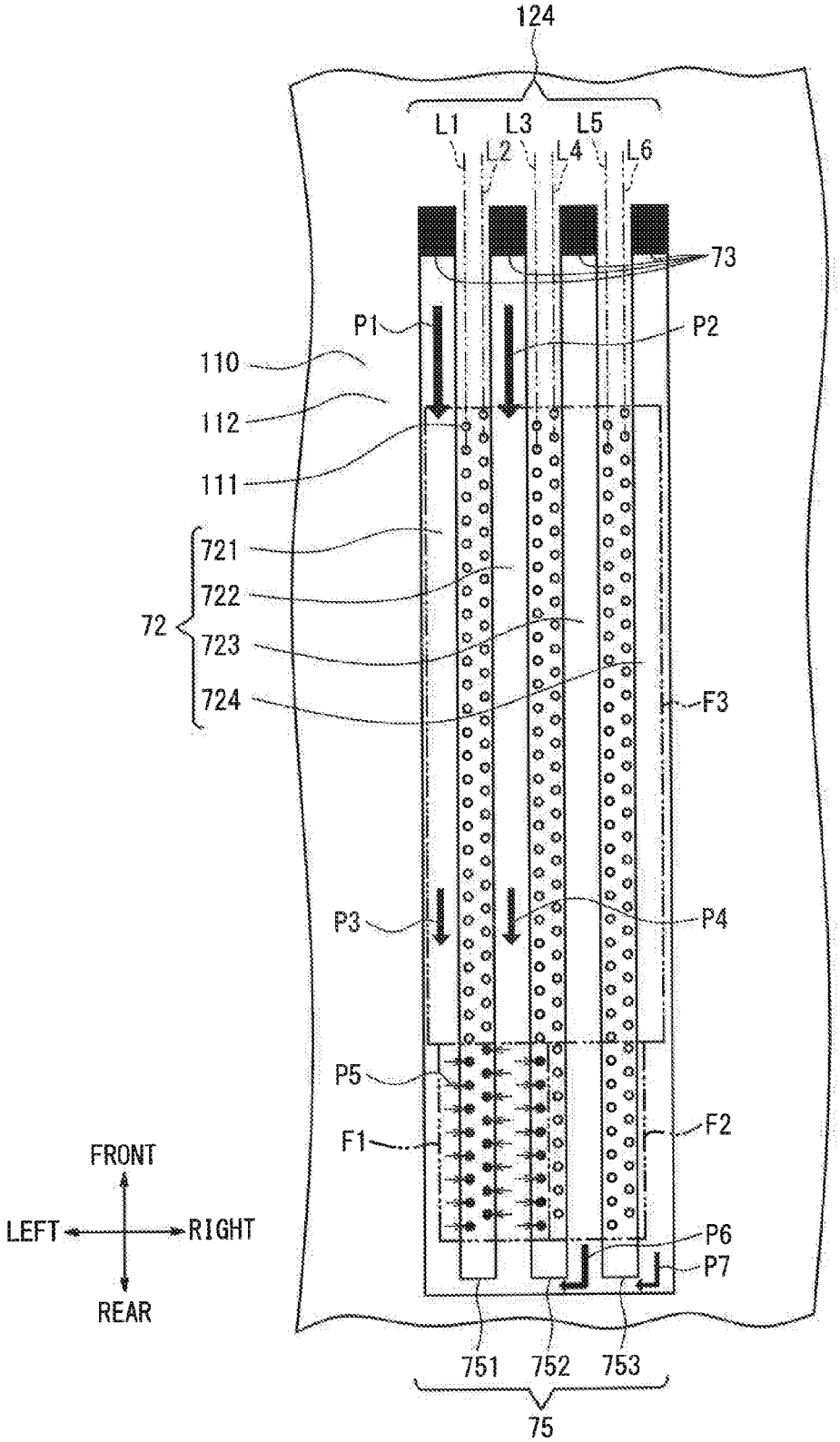
FIG. 15 is a schematic view showing first selective flushing according to a modified example.

The modified example will be explained with reference to FIG. 15 and FIG. 16. As shown in FIG. 15, in the first selective flushing according to the modified example, the ink is ejected from the nozzles 111 arranged in a first region F1, among the nozzles 111 included in the nozzle arrays L1 to L3. The first region F1 is a region of the nozzle arrays L1 to L3 and corresponds to the rear end side of the supply passages 721 and 722 that is adjacent to the communication paths 75. Further, among the nozzles 111 included in the nozzle arrays L1 to L3, the ink is not ejected from the nozzles 111 arranged in a third region F3, which is a region on the front end side of the supply passages 72 with respect to the first region F1.

When the first selective flushing according to the modified example is performed, the ink is supplied from the supply passage 721 to the nozzles 111 arranged in the first region F1 in the nozzle array L1. Further, the ink is supplied from the supply passage 722 to the nozzles 111 arranged in the first region F1 in the nozzle arrays L2 and L3. At this time, ink flows shown by arrows P1 and P2 are generated in the vicinity of the supply ports 73 of the supply passages 721 and 722, respectively. The ink supplied to the supply passages 721 and 722 from the supply ports 73 is supplied to the nozzles 111 arranged in the rear end side of the supply passages 721 and 722 (refer to arrows P5) while the flow rate of the ink gradually attenuates as the ink flows away from the supply ports 73 (refer to arrows P3 and P4).

As the ink is ejected from the nozzles 111 arranged in the first region F1 in the nozzle arrays L1 to L3, the ink in the rear end side of the supply passages 721 and 722 decreases, and a negative pressure is generated in the rear end side of the supply passages 721 and 722. Due to the negative pressure, the ink is drawn from the supply ports 73 of the supply passages 721 and 722, and thus the ink is supplied to the supply passages 721 and 722. At this time, the ink is not ejected from the nozzle arrays L4 to L6, and therefore, the ink is stored in the supply passages 723 and 724 such that the supply passages 723 and 724 are substantially filled with the ink. The ink stored in the supply passages 723 and 724 is drawn via the communication paths 752 and 753 due to the negative pressure generated in the rear end side of the supply passages 721 and 722, and flows toward the supply passages 721 and 722 (refer to arrows P6 and P7).

The ink ejected by the flushing is discarded without being used for printing. In the first selective flushing according to the above-described embodiment, the number of the nozzle arrays on which the flushing is performed is smaller than that in the first selective flushing according to the modified example. Therefore, the amount of the ink that is necessary for the first selective flushing according to the embodiment is smaller than the amount of the ink that is necessary for the first selective flushing according to the modified example. Therefore, the first selective flushing according to the embodiment is advantageous in that it is possible to reduce the amount of the ink that is discarded without being used for printing, in comparison to the first selective flushing according to the modified example.

On the other hand, in the first selective flushing according to the modified example, an ink ejection amount is larger than that in the first selective flushing according to the embodiment. Therefore the ink flows (refer to the arrows P6 and P7 in FIG. 15) that are generated in the communication paths 752 and 753 by the first selective flushing according to the modified example are greater than the ink flows (refer to the arrows M6 and M7 in FIG. 12) that are generated in the communication paths 752 and 753 by the first selective flushing according to the embodiment. Therefore, the first selective flushing according to the modified example is advantageous in that it is possible to improve the fluidity of the ink in the communication paths 752 and 753, in comparison to the first selective flushing according to the embodiment.

Figure 16:
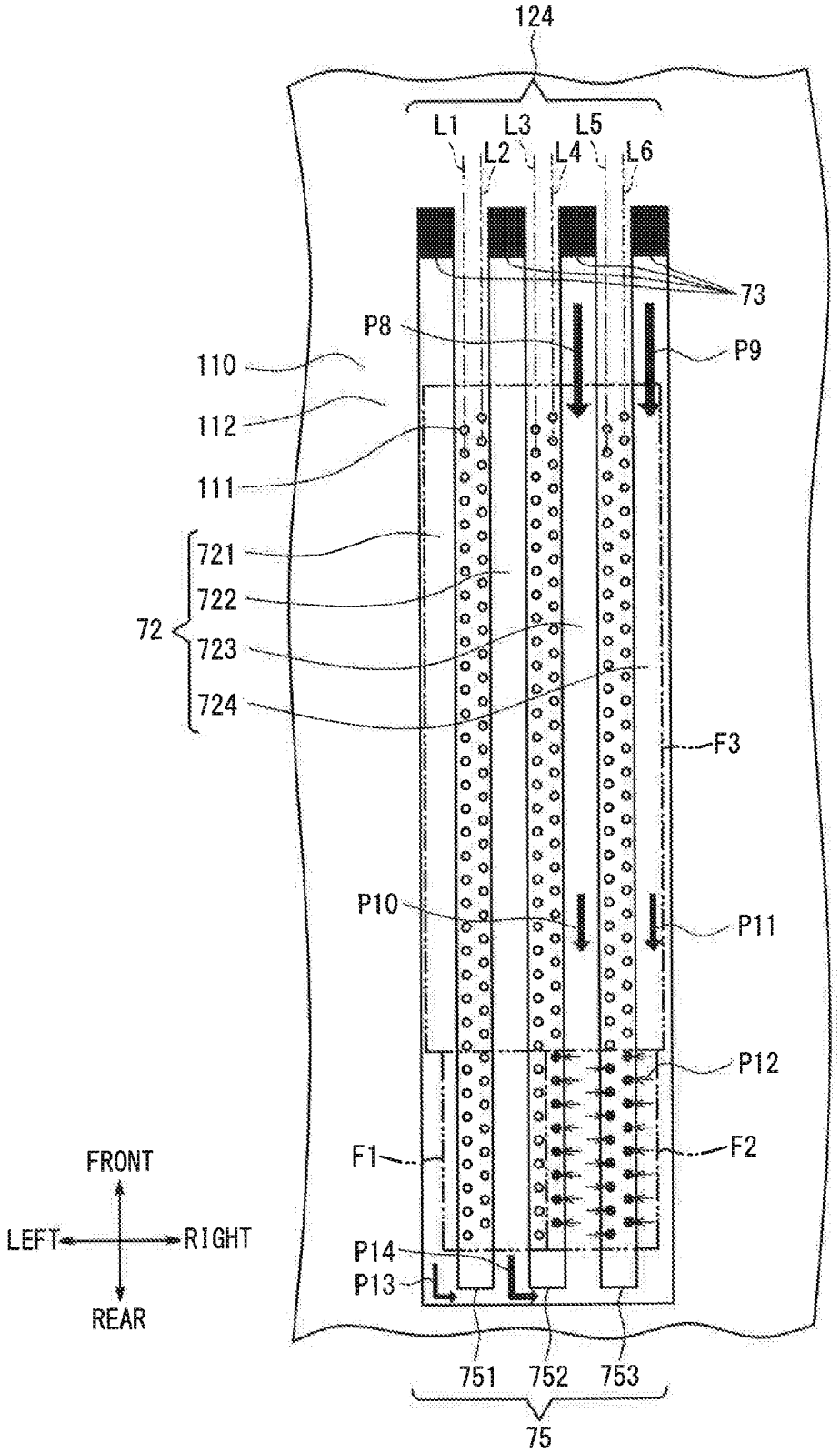
FIG. 16 is a schematic view showing second selective flushing according to the modified example.

As shown in FIG. 16, in the second selective flushing according to the modified example, among the nozzles 111 included in the nozzle arrays L4 to L6, the ink is ejected from the nozzles 111 arranged in a second region F2, which is a region on the rear end side of the supply passages 72 that are adjacent to the communication paths 75. Further, among the nozzles 111 included in the nozzle arrays L4 to L6, the ink is not ejected from the nozzles 111 arranged in the third region F3 that is on the front end side of the supply passages 72 with respect to the second region F2.

When the second selective flushing according to the modified example is performed, the ink is supplied from the supply passages 723 and 724 to the nozzles 111 arranged in the second region F2 in the nozzle arrays L4 to L6. At this time, ink flows shown by arrows P8 and P9 are generated in the vicinity of the supply ports 73 of the supply passages 723 and 724, respectively. The ink supplied from the supply ports 73 to the supply passages 723 and 724 is supplied to the nozzles 111 arranged in the rear end side of the supply passages 723 and 724 (refer to arrows P12) while the flow rate of the ink gradually attenuates as the ink flows away from the supply ports 73 (refer to arrows P10 and P11).

As the ink is ejected from the nozzles 111 arranged in the second region F2 in the nozzle arrays L4 to L6, the ink in the rear end side of the supply passages 723 and 724 decreases. Along with this, the ink is drawn from the supply ports 73 of the supply passages 723 and 724, and the ink is supplied to the supply passages 723 and 724. At this time, the ink is not ejected from the nozzle arrays L1 to L3. Therefore, the ink stored in the supply passages 721 and 722 is drawn via the communication paths 751 and 752, and flows toward the supply passages 723 and 724 (refer to arrows P13 and P14).

In the second selective flushing according to the embodiment, the number of the nozzle arrays on which the flushing is performed is smaller than that in the second selective flushing according to the modified example. Therefore, in the second selective flushing according to the embodiment, it is possible to reduce the amount of the ink that is discarded without being used for printing, in comparison to the second selective flushing according to the modified example. On the other hand, in the second selective flushing according to the modified example, an ink ejection amount is larger than that in the second selective flushing according to the embodiment. Therefore, in the second selective flushing according to the modified example, it is possible to improve the fluidity of the ink in the communication paths 751 and 752, in comparison to the second selective flushing according to the embodiment.

In this manner, each of the different forms of the selection of the nozzle arrays on which the flushing is performed by the first and second selective flushing has an advantageous point. The nozzle arrays on which the flushing is to be performed by the first and second selective flushing may be selected by taking into consideration results of experiments performed in advance to improve the print quality, such as a balance between the amount of the ink that can be used for the flushing and an improvement in the fluidity of the ink in the communication paths 75, and the like.

The modified example is also not limited to the above-described example, and various modifications can be made to the above-described embodiment and the modified example. For example, in the above-described embodiment and the modified example, in the first and second selective flushing, the ink is ejected from the nozzles 111 arranged in the first regions E1 and F1 and the second regions E2 and F2. In the first selective flushing, among the nozzles 111 included in the nozzle arrays, it is sufficient if the ink is ejected from the nozzles 111 that include at least the nozzles 111 arranged in the first regions E1 and F1. In the second selective flushing, among the nozzles 111 included in the nozzle arrays, it is sufficient if the ink is ejected from the nozzles 111 that include at least the nozzles 111 arranged in the second regions E2 and F2.

The description will be made more specifically. In the above-described embodiment, the first region E1, which is a target for the first selective flushing, is a region including the nozzles 111 arranged in positions covering approximately one fifth of the supply passages 72 from the rear end side of the supply passages 72, among the nozzles 111 included in the nozzle arrays L2 and L3 (refer to FIG. 12). Further, the second region E2, which is a target for the second selective flushing, is a region including the nozzles 111 arranged in positions covering approximately one fifth of the supply passages 72 from the rear end side of the supply passages 72, among the nozzles 111 included in the nozzle arrays L4 and L5 (refer to FIG. 14). For example, the first region E1 and the second region E2 may be regions including the nozzles 111 arranged in positions covering approximately one third of the supply passages 72 from the rear end side of the supply passages 72, among the nozzles 111 included in the nozzle arrays. Further, the first region E1 and the second region E2 may be regions including the nozzles 111 arranged in positions covering approximately one half of the supply passages 72 from the rear end side of the supply passages 72. Further, the ink may be ejected from all of the nozzles 111 included in the nozzle arrays on which the first and second selective flushing is performed. In the nozzle arrays on which the first and second selective flushing is performed, the smaller the number of the nozzles 111 from which the ink is ejected, the more the printer 1 can reduce the amount of the ink that is discarded without being used for printing. On the other hand, in the nozzle arrays on which the first and second selective flushing is performed, the larger the number of the nozzles 111 from which the ink is ejected, the more easily the printer 1 can improve the fluidity of the ink in the communication paths 75. Among the nozzles 111 arranged in the first region E1 and the second region E2, the ink need not necessarily be ejected from some of the nozzles 111 on the side of the communication paths 75 (namely, on the rear end side of the supply passages 72) when the first and second selective flushing is performed.

When the overall flushing is performed for the head units 100 and 200, among all the nozzles 111 including the nozzles 111 arranged in the third regions E3 and F3, the ink need not necessarily be ejected from some of the nozzles 111.

The overall flushing need not necessarily be performed for the head unit 100 between the execution of the first selective flushing and the execution of the second selective flushing. For example, when the second selective flushing is performed for the head unit 100 immediately after the first selective flushing, the flow in the same direction is repeatedly generated in each of the communication paths 751 and 753 (refer to the arrow M14 and the arrow M16 in FIG. 14). In this case, the flow in the same direction continues for a longer time in each of the communication paths 751 and 753 than in a case in which the overall flushing is performed between the execution of the first selective flushing and the execution of the second selective flushing. Therefore, the printer 1 can effectively eliminate the clogging of the communication paths 751 and 753. After performing the first selective flushing and the second selective flushing continuously, the printer 1 may perform the overall flushing. In this case, while the printer 1 effectively eliminates the clogging of the communication paths 751 and 753, the printer 1 also ejects the ink from the nozzles 111 from which the ink has not been ejected by the first and second selective flushing. The printer 1 can thus inhibit drying out of the ink in the nozzles 111 with respect to the entire head unit 100.

When it is possible to improve the print quality sufficiently by performing the series of flushing operations once, it is sufficient if the printer 1 performs the series of flushing operations once after performing the purging, for example, and the printer 1 need not necessarily perform the series of flushing operations before and after the purging.

In the printer 1, depending on the shape or the like of the supply passages 72 and the communication paths 75, when ink clogging tends to occur only at particular positions in the supply passages 72 and the communication paths 75, it is sufficient if selective flushing is performed to improve the fluidity of the ink at the particular positions. For example, the second selective flushing need not necessarily be performed for the head unit 100 after the first selective flushing is performed.

In the above-described embodiment, the CPU 40 performs the first selective flushing for the head unit 100. Additionally, the CPU 40 performs, for the head unit 200, the overall flushing, which is a form of flushing different from the first selective flushing (refer to step S3 in FIG. 11). The overall flushing for the head unit 200 is performed for the same period (two seconds) during which the first selective flushing is performed for the head unit 100. The period during which the overall flushing is performed for the head unit 200 may be shorter than the period during which the first selective flushing is performed for the head unit 100. This is because it is sufficient that the period during which the overall flushing is performed for the head unit 200 is a period sufficient to inhibit a deterioration in ejection performance due to drying out or the like of the color inks.

The flushing that is performed for the head unit 200 in the processing at step S3 may be a form of flushing in which, for example, all of the plurality of nozzles 111 in the head unit 200 are filled with the ink by causing the nozzle arrays L1 to L6 to eject the ink sequentially one array at a time. By doing this, it is possible to reduce the number of the piezoelectric elements that are driven simultaneously by the processing at step S3, and it is thus possible to suppress the peak in the power consumption of the printer 1. While the series of flushing operations is being performed for the head unit 100, there may be a case in which a problem caused by drying out or the like of the ink in the head unit 200 does not occur. In this case, in the processing at step S3, the flushing need not necessarily be performed for the head unit 200.

In the above-described embodiment, the first and second selective flushing, namely, the plurality of types of selective flushing can be performed. However, the present disclosure is not limited to this example. More specifically, execution of only one type of selective flushing may be allowed. In this case, the selective flushing is performed in the following manner. For example, the ink is ejected from all or some of the nozzles 111 arranged in the first region E1 and the second region E2, and the ink is not ejected from the nozzles 111 arranged in the third region E3. Alternatively, for example, the ink is ejected from all or some of the nozzles 111 arranged in the first region F1 and the second region F2, and the ink is not ejected from the nozzles 111 arranged in the third region F3.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a head portion including a nozzle arrangement, the nozzle arrangement having nozzle arrays arranged in a first direction, each of the nozzle arrays having nozzles arranged in a second direction crossing the first direction, each of the nozzles being provided to eject liquid;

a set of liquid passages provided to supply the liquid to the nozzle arrangement, the set of liquid passages having liquid passages arranged in the first direction and interconnected via a communication path, the nozzles in each one of the nozzle arrays being connected to a corresponding one of the liquid passages, each of the liquid passages extending in the second direction and having a first end and a second end in the second direction, the first end being connected to a supply port provided to supply the liquid to the liquid passage, and the second end being an end opposite to the first end and connected to the communication path;

a controller configured to control a flushing operation of the head portion, the flushing operation being an operation of ejecting the liquid from the nozzles as waste liquid, and the waste liquid not being used for printing; and the controller being configured to control the head portion to perform a selective flushing operation, the selective flushing operation being an operation of ejecting the liquid from the nozzles corresponding to a part, being at least one of the liquid passages, of the set of liquid passages while stopping ejection of the liquid from the nozzles corresponding to a remaining part of the set of liquid passages.

2. The print device according to claim 1, wherein the controller is configured to control the head portion to perform the selective flushing operation, the selective flushing operation being an operation of ejecting the liquid from the nozzles included in a region in the nozzle arrangement while stopping ejection of the liquid from the nozzles out of the region, the region being located on the second end side, in the second direction, of the liquid passage.

3. The print device according to claim 2, wherein the controller is configured to control the head portion to eject the liquid from a closest nozzle to the second end in the nozzle array when performing the selective flushing operation.

4. The print device according to claim 2, wherein the controller is configured to control the head portion so as not to eject the liquid from the nozzles included in the nozzle array arranged on an end, in the first direction, of the nozzle arrays when performing the selective flushing operation.

5. The print device according to claim 2, wherein the controller is configured to control the head portion to:

perform a first selective flushing operation as the selective flushing operation, the first selective flushing operation being an operation of ejecting the liquid from the nozzles included in a first region in the nozzle arrangement while stopping ejection of the liquid from the nozzles out of the first region, the first region corresponding to a first part, being at least one of the liquid passages, of the set of liquid passages and being located on the second end side, in the second direction, of the liquid passage; and perform a second selective flushing operation as the selective flushing operation, the second selective flushing operation being an operation of ejecting the liquid from the nozzles included in a second region in the nozzle arrangement while stopping ejection of the liquid from the nozzles out of the second region, the second region corresponding to a second part, being at least one of the liquid passages, of the set of liquid passages and being located on the second end side, in the second direction, of the liquid passage, the second part having the nozzle array different from the first part.

6. The print device according to claim 5, wherein each of the first part and the second part includes a plurality of the nozzle arrays.

7. The print device according to claim 5, wherein the first part does not include the nozzle array included in the second part.

8. The print device according to claim 5, wherein the controller is configured to control the head portion to:

perform an overall flushing operation as the flushing operation, the overall flushing operation being an operation of ejecting the liquid from the nozzles included in the first region, the second region and a third region, the third region being a region on the first end side of the nozzle arrays, with respect to the first region and the second region.

9. The print device according to claim 8, wherein the controller is configured to control the head portion to:

perform the overall flushing operation after performing the first selective flushing operation, and perform the second selective flushing operation after performing the overall flushing operation.

10. The print device according to claim 8, wherein the controller is configured to control the head portion to:

perform the second selective flushing operation after performing the first selective flushing operation, and perform the overall flushing operation after performing the second selective flushing operation.

11. The print device according to claim 5, further comprising:

a first head unit having the head portion mounted thereon, the head portion ejecting a first liquid, as the liquid, onto the print medium; and a second head unit having the head portion mounted thereon, the head portion ejecting a second liquid, as the liquid, onto the print medium, a pigment contained in the second liquid being less likely to sediment compared to a pigment contained in the first liquid, wherein the controller is configured to control operation of the head portion such that the first selective flushing operation and the second selective flushing operation are performed in the head portion of the first head unit.

12. The print device according to claim 11, wherein the controller is configured to control the first and second head units to:

perform a flushing operation different from the selective flushing operation in the head portion of the second head unit when the selective flushing operation is performed in the head portion of the first head unit.

13. The print device according to claim 11, further comprising:

a cap, wherein the cap is provided to be selectively settable to a cover state and a release state, the cover state being a state in which the nozzles of the head portion in the first head unit and the nozzles of the head portion in the second head unit are covered, and the release state being a state in which the nozzles are not covered, and the controller is configured to control operation of the head portion and the cap to:

set the cap to one of the cover state and the release state; and perform the first selective flushing operation and the second selective flushing operation for the nozzles of the head portion in the first head unit and also perform the flushing operation different from the first selective flushing operation and the second selective flushing operation for the nozzles of the head portion in the second head unit, when the cap is set to the release state.

14. The print device according to claim 13, wherein the print device is capable of performing purging to eject the liquid from the nozzles by applying a pressure to an inner portion of the cap in the cover state; and wherein the controller is configured to control operation of the head portion and the cap to perform the first selective flushing operation and the second selective flushing operation before and after performing the purging.

15. The print device according to claim 5, wherein the second region is arranged adjacent to the first region in the first direction.

* * * * *